US011631422B2

(12) United States Patent
Mate et al.

(10) Patent No.: US 11,631,422 B2
(45) Date of Patent: Apr. 18, 2023

(54) METHODS, APPARATUSES AND COMPUTER PROGRAMS RELATING TO SPATIAL AUDIO

(71) Applicant: NOKIA TECHNOLOGIES OY, Espoo (FI)

(72) Inventors: Sujeet Shyamsundar Mate, Tampere (FI); Arto Lehtiniemi, Lempäälä (FI); Antti Eronen, Tampere (FI); Jussi Leppänen, Tampere (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 52 days.

(21) Appl. No.: 16/769,345

(22) PCT Filed: Dec. 3, 2018

(86) PCT No.: PCT/IB2018/059573

§ 371 (c)(1),
(2) Date: Jun. 3, 2020

(87) PCT Pub. No.: WO2019/123060

PCT Pub. Date: Jun. 27, 2019

(65) Prior Publication Data

US 2020/0312347 A1 Oct. 1, 2020

(30) Foreign Application Priority Data

Dec. 19, 2017 (EP) ..... 17208376

(51) Int. Cl.
*G10L 21/0308* (2013.01)
*G10L 25/54* (2013.01)
*H04S 7/00* (2006.01)

(52) U.S. Cl.
CPC ..... *G10L 21/0308* (2013.01); *G10L 25/54* (2013.01); *H04S 7/303* (2013.01)

(58) Field of Classification Search
CPC . G10L 21/0308; G10L 25/54; G10L 21/0272; H04S 7/303; H04S 7/305;
(Continued)

(56) References Cited

U.S. PATENT DOCUMENTS 10,045,120 B2 * 8/2018 Adsumilli ..... G01S 3/7864
2015/0189457 A1 * 7/2015 Donaldson ..... H04M 3/56 381/1

(Continued)

FOREIGN PATENT DOCUMENTS

EP 3 236 345 A1 10/2017
JP 2017092732 A 5/2017

OTHER PUBLICATIONS

International Search Report and Written Opinion dated Mar. 27, 2019 corresponding to International Patent Application No. PCT/IB2018/059573.

(Continued)

*Primary Examiner* — Linda Wong
(74) *Attorney, Agent, or Firm* — Squire Patton Boggs (US) LLP

(57) ABSTRACT

An apparatus is disclosed, configured to receive, from first and second spatial audio capture apparatuses, respective first and second composite audio signals comprising components derived from one or more sound sources in a capture space. The apparatus is further configured to identify a position of a user device corresponding to one of first and second areas respectively associated with the positions of the first and second spatial audio capture apparatuses, and to render audio representing the one or more sound sources to the user device, the rendering being performed differently dependent on, for the spatial audio capture apparatus associated with the identified first or second area, whether or not individual (Continued)

audio signals from each of the one or more sound sources can be successfully separated from its composite signal.

13 Claims, 10 Drawing Sheets

(58) Field of Classification Search
CPC ..... H04S 7/40; H04S 2400/15; H04S 7/304; H04S 7/306; H04S 2400/11; H04S 2420/01; H04R 1/406
See application file for complete search history.

(56) References Cited

U.S. PATENT DOCUMENTS

| | | | | |
|---|---|---|---|---|
| 2016/0212562 | A1 | 7/2016 | Ojanpera | |
| 2017/0309289 | A1 | 10/2017 | Eronen et al. | |
| 2018/0068677 | A1* | 3/2018 | Suzuki | G10L 25/78 |
| 2019/0198036 | A1* | 6/2019 | Osako | G06N 3/0454 |
| 2021/0266694 | A1* | 8/2021 | Mate | H04S 7/30 |

OTHER PUBLICATIONS

Zheng Xiguang et al: "Encoding and communicating navigable speech soundfields," Multimedia Tools and Applications, vol. 75, No. 9, Nov. 5, 2015, pp. 5183-5204, XP035924708.
Susal Joel et al: "Immersive Audio for VR," Conference: 2016 AES International Conference on Audio for Virtual and Augmented Reality, Sep. 21, 2016, XP040681042.
Notice of Reasons for Rejection dated Sep. 7, 2021 corresponding to Japanese Patent Application No. 2020-533653, with English summary thereof.

* cited by examiner

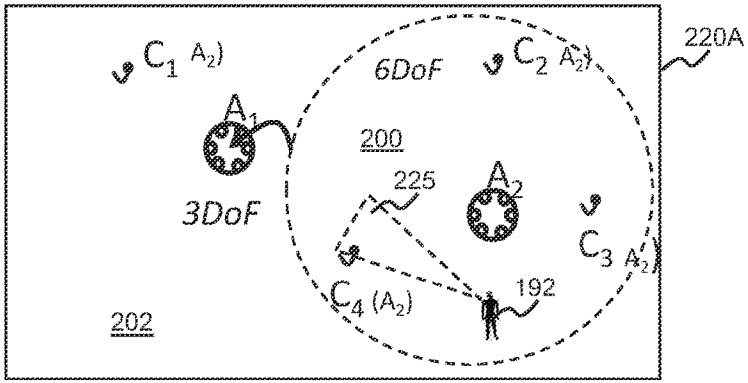
Fig. 6(a)
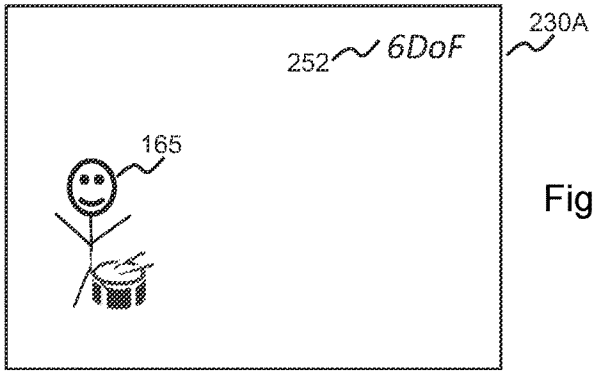
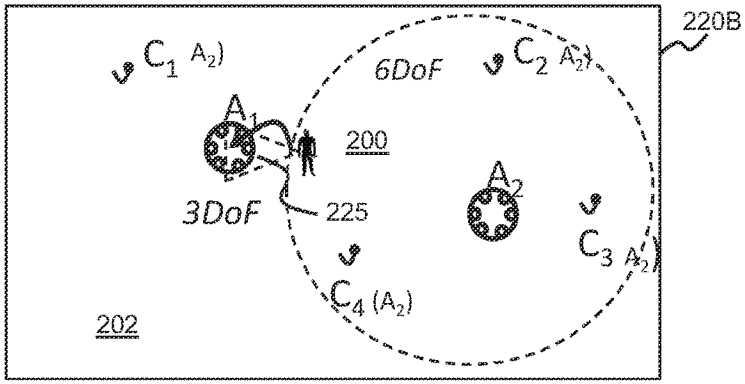
Fig. 6(b)
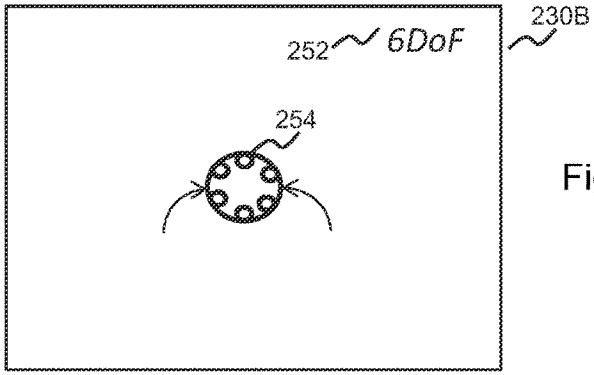
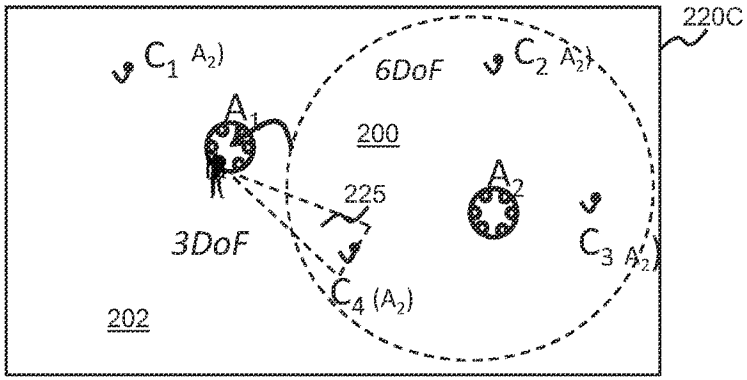
Fig. 6(c)
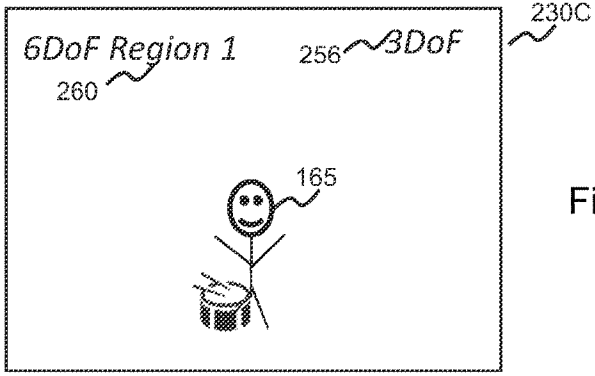

METHODS, APPARATUSES AND COMPUTER PROGRAMS RELATING TO SPATIAL AUDIO

FIELD

This specification relates to methods, apparatuses and computer programs relating to spatial audio, and to rendering spatial audio dependant on the position of a user device in relation to a virtual space.

BACKGROUND

Audio signal processing techniques allow identification and separation of individual sound sources from audio signals which include components from a plurality of different sounds sources. Once an audio signal representing an identified audio signal has been separated from the remainder of the signal, characteristics of the separated signal may be modified in order to provide different audible effects to a listener.

SUMMARY

A first aspect provides an apparatus, comprising: means for receiving, from a first spatial audio capture apparatus, a first composite audio signal comprising components derived from one or more sound sources in a capture space; means for identifying a position of a user device in relation to the first spatial audio capture apparatus; and means, responsive to the position of the user device corresponding to a first area associated with the position of the first spatial audio capture apparatus, to render audio representing the one or more sound sources to the user device, the rendering being performed differently dependent on whether or not individual audio signals from each of the one or more sound sources can be successfully separated from the first composite signal.

The means for rendering audio may be configured such that rendering is performed differently dependent on whether or not individual audio signals from all sound sources within a predetermined range of the spatial audio capture apparatus, associated with the identified first area, can be successfully separated from its composite audio signal.

The means for rendering audio may be configured such that successful separation is determined by calculating, for each individual audio signal, a measure of success for the separation and determining whether or not it meets a predetermined success threshold.

The means for rendering audio may be configured such that the measure of success is calculated using one or more of: a correlation between a remainder of the composite audio signal and at least one reference audio signal; a correlation between a frequency spectrum associated with the remainder of the composite audio signal and a frequency spectrum associated with a reference audio signal; and a correlation between a remainder of composite audio signal and a component of a video signal corresponding to the composite audio signal.

The apparatus may further comprise means for receiving from a second spatial audio capture apparatus a second composite audio signal comprising components derived from the one or more sound sources in the capture space, and means for identifying the position of the user device as corresponding to the first area or a second area associated with the second spatial audio capture apparatus, wherein the means for rendering audio is configured such that if the one or more sound sources can be successfully separated from the first but not the second composite audio signal, the rendering is performed differently for the first and second areas.

The means for rendering audio may be configured such that, for a user device position within the first area, volumetric audio rendering is performed in such a way that a detected change of user device position within the first area results in a change in position of the audio signal for the one or more of the sound sources to create the effect of user device movement.

The means for rendering audio may be configured such that detected translational and rotational changes of user device position result in a substantially corresponding translational and rotational change in position of the audio signal for the one or more sound sources.

The means for rendering audio may be configured such that the volumetric rendering is performed using a mix comprising (i) a modified version of the first composite signal from which the individual audio signals are removed, and (ii) a modified version of each of the individual audio signals The means for rendering audio may be configured such that the modified version of an individual audio signal comprises a wet version of said individual audio signal, generated by applying an impulse response of the capture space to the individual audio signal.

The means for rendering audio may be configured such that the wet version of the individual audio signal is further mixed with a dry version of the individual audio signal.

The means for rendering audio may be configured such that for a user device position within the second area, audio rendering is performed such that: (i) the position of the audio sources change to reflect a rotational change in user device position; or (ii) the position of the audio sources change using volumetric audio rendering based on signals from the first spatial audio capture apparatus.

The apparatus may further comprise means to provide video data for rendering to a display screen of the user device, the video data representing captured video content and further comprising an indication of whether the user device position corresponds to the first area or another area.

The means to provide video data may be configured such that the video data comprises an indication that a boundary of the first area with the other area is being approached and that a change in audio rendering will result from crossing the boundary.

The means to provide video data may be configured such that the video data comprises a shortcut, selection of which is effective to return the user device position to the other one of the first area and the other area.

The apparatus may further comprise means to provide a user interface for displaying a representation of the first area, the audio rendering to be used for the first area, and to enable modification of the size and/or shape of the first and area.

The means to provide the user interface may be configured such that the user interface further permits modification of the audio rendering to be used for the first area.

Another aspect provides a method, comprising: receiving, from a first spatial audio capture apparatus a first composite audio signal comprising components derived from one or more sound sources in a capture space; receiving individual audio signals derived from each of the one or more sound sources; identifying a position of a user device in relation to the first spatial audio capture apparatus; and responsive to the position of the user device corresponding to a first area associated with the position of the first spatial audio capture apparatus, rendering audio representing the one or more sound sources to the user device, the rendering being performed differently dependent on whether or not the individual audio signals can be successfully separated from the first composite signal.

The rendering may be performed differently dependent on whether or not individual audio signals from all sound sources within a predetermined range of the spatial audio capture apparatus, associated with the identified first area, can be successfully separated from its composite audio signal.

The rendering may be such that successful separation is determined by calculating, for each individual audio signal, a measure of success for the separation and determining whether or not it meets a predetermined success threshold.

The rendering may be such that the measure of success is calculated using one or more of: a correlation between a remainder of the composite audio signal and at least one reference audio signal; a correlation between a frequency spectrum associated with the remainder of the composite audio signal and a frequency spectrum associated with a reference audio signal; and a correlation between a remainder of composite audio signal and a component of a video signal corresponding to the composite audio signal.

The method may further comprise receiving from a second spatial audio capture apparatus a second composite audio signal comprising components derived from the one or more sound sources in the capture space, and identifying the position of the user device as corresponding to the first area or a second area associated with the second spatial audio capture apparatus, wherein rendering audio is such that if the one or more sound sources can be successfully separated from the first but not the second composite audio signal, the rendering is performed differently for the first and second areas.

The rendering audio may be such that, for a user device position within the first area, volumetric audio rendering is performed in such a way that a detected change of user device position within the first area results in a change in position of the audio signal for the one or more of the sound sources to create the effect of user device movement.

The rendering audio may be such that detected translational and rotational changes of user device position result in a substantially corresponding translational and rotational change in position of the audio signal for the one or more sound sources.

The rendering audio may be such that the volumetric rendering is performed using a mix comprising (i) a modified version of the first composite signal from which the individual audio signals are removed, and (ii) a modified version of each of the individual audio signals The rendering audio may be such that the modified version of an individual audio signal comprises a wet version of said individual audio signal, generated by applying an impulse response of the capture space to the individual audio signal.

The rendering audio may be configured such that the wet version of the individual audio signal is further mixed with a dry version of the individual audio signal.

The rendering audio may be such that for a user device position within the second area, audio rendering is performed such that: (i) the position of the audio sources change to reflect a rotational change in user device position; or (ii) the position of the audio sources change using volumetric audio rendering based on signals from the first spatial audio capture apparatus.

The method may further comprise providing video data for rendering to a display screen of the user device, the video data representing captured video content and further comprising an indication of whether the user device position corresponds to the first area or another area.

Providing video data may be such that the video data comprises an indication that a boundary of the first area with the other area is being approached and that a change in audio rendering will result from crossing the boundary.

Providing video data may be such that the video data comprises a shortcut, selection of which is effective to return the user device position to the other one of the first area and the other area.

The method may further comprise providing a user interface for displaying a representation of the first area, the audio rendering to be used for the first area, and to enable modification of the size and/or shape of the first and area.

Providing the user interface may be such that the user interface further permits modification of the audio rendering to be used for the first area.

Another aspect provides computer-readable instructions which, when executed by computing apparatus, cause the computing apparatus to cause performance of the above method operations.

Another aspect provides a non-transitory computer-readable medium having stored thereon computer-readable code, which, when executed by at least one processor, causes the at least one processor to perform a method, comprising: receiving, from a first spatial audio capture apparatus, a first composite audio signal comprising components derived from one or more sound sources in a capture space; receiving individual audio signals derived from each of the one or more sound sources; identifying a position of a user device in relation to the first spatial audio capture apparatus; and responsive to the position of the user device corresponding to a first area associated with the position of the first spatial audio capture apparatus, rendering audio representing the one or more sound sources to the user device, the rendering being performed differently dependent on whether or not the individual audio signals can be successfully separated from the first composite signal.

Another aspect provides an apparatus, the apparatus having at least one processor and at least one memory having computer-readable code stored thereon which when executed controls the at least one processor: to receive, from a first spatial audio capture apparatus a first composite audio signal comprising components derived from one or more sound sources in a capture space; to receive individual audio signals derived from each of the one or more sound sources; to identify a position of a user device in relation to the first spatial audio capture apparatus; and responsive to the position of the user device corresponding to a first area associated with the position of the first spatial audio capture apparatus, to render audio representing the one or more sound sources to the user device, the rendering being performed differently dependent on whether or not the individual audio signals can be successfully separated from the first composite signal.

BRIEF DESCRIPTION OF THE FIGURES

For better understanding of the present application, reference will be made by way of example to the accompanying drawings in which:

FIGS. 6*a*-6*c* show schematic plan and user interface views in respective stages of user movement in which an indication is presented on the user interface to indicate transition between regions, in accordance with various examples described herein;

DETAILED DESCRIPTION OF EMBODIMENTS

Figure 1:
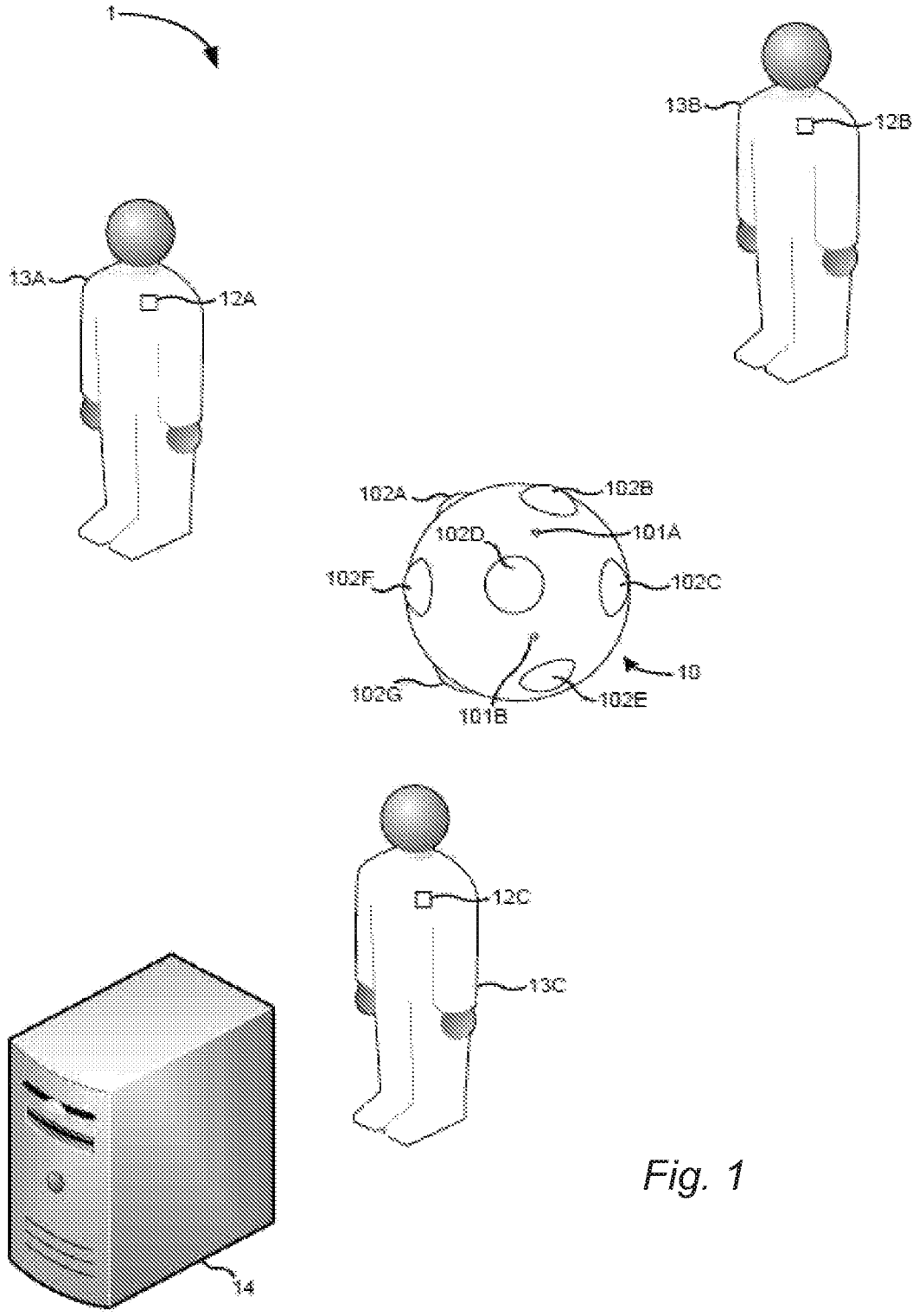
FIG. 1 is an example of an audio capture system which may be used in order to capture audio signals for processing in accordance with various examples described herein.

In the description and drawings, like reference numerals refer to like elements throughout.

FIG. 1 is an example of an audio capture system 1 which may be used in order to capture audio signals for processing in accordance with various examples described herein. In this example, the system 1 comprises a spatial audio capture apparatus 10 configured to capture a spatial audio signal, and one or more additional audio capture devices 12A, 12B, 12C.

The spatial audio capture apparatus 10 comprises a plurality of audio capture devices 101A, B (e.g. directional or non-directional microphones) which are arranged to capture audio signals which may subsequently be spatially rendered into an audio stream in such a way that the reproduced sound is perceived by a listener as originating from at least one virtual spatial position. Typically, the sound captured by the spatial audio capture apparatus 10 is derived from plural different sound sources which may be at one or more different locations relative to the spatial audio capture apparatus 10. As the captured spatial audio signal includes components derived from plural different sounds sources, it may be referred to as a composite audio signal. Although only two audio capture devices 101A, B are visible in FIG. 1, the spatial audio capture apparatus 10 may comprise more than two devices 101A, B. For instance, in some specific examples, the audio capture apparatus 10 may comprise eight audio capture devices.

In the example of FIG. 1, the spatial audio capture apparatus 10 is also configured to capture visual content (e.g. video) by way of a plurality of visual content capture devices 102A-G (e.g. cameras). The plurality of visual content capture devices 102A-G of the spatial audio capture apparatus 10 may be configured to capture visual content from various different directions around the apparatus, thereby to provide immersive (or virtual reality content) for consumption by users. In the example of FIG. 1, the spatial audio capture apparatus 10 is a presence-capture device, such as Nokia's OZO camera. However, as will be appreciated, the spatial audio capture apparatus 10 may be another type of device and/or may be made up of plural physically separate devices. For example, the spatial audio capture apparatus 10 may record only audio and not video. As another example, the spatial audio capture apparatus may be a mobile phone. As will also be appreciated, although the content captured may be suitable for provision as immersive content, it may also be provided in a regular non-VR format for instance via a smart phone or tablet computer.

As mentioned previously, in the example of FIG. 1, the spatial audio capture system 1 further comprises one or more additional audio capture devices 12A-C. Each of the additional audio capture devices 12A-C may comprise at least one microphone and, in the example of FIG. 1, the additional audio capture devices 12A-C are lavalier microphones configured for capture of audio signals derived from an associated user 13A-C. For instance, in FIG. 1, each of the additional audio capture devices 12A-C is associated with a different user by being affixed to the user in some way. However, it will be appreciated that, in other examples, the additional audio capture devices 12A-C may take a different form and/or may be located at fixed, predetermined locations within an audio capture environment. In some embodiments, all or some of the additional audio capture devices may be mobile phones.

The locations of the additional audio capture devices 12A-C and/or the spatial audio capture apparatus 10 within the audio capture environment may be known by, or may be determinable by, the audio capture system 1 (for instance, the audio processing apparatus 14). For instance, in the case of mobile audio capture apparatuses, the apparatuses may include location determination component for enabling the location of the apparatuses to be determined. In some specific examples, a radio frequency location determination system such as High Accuracy Indoor Positioning may be employed, whereby the additional audio capture devices 12A-C (and in some examples the spatial audio capture apparatus 10) transmit messages for enabling a location server to determine the location of the additional audio capture devices within the audio capture environment. In other examples, for instance when the additional audio capture devices 12A-C are static, the locations may be pre-stored by an entity which forms part of the audio capture system 1 (for instance, audio processing apparatus 14). In a yet another example, a human operator may input the positions on a device equipped with a touch screen by using his finger or other pointing device. In yet another example, methods of audio-based self-localization may be applied, where the one or more audio capture devices analyze the captured audio signals to determine the device locations.

In the example of FIG. 1, the audio capture system 1 further comprises audio processing apparatus 14. The audio processing apparatus 14 is configured to receive and store signals captured by the spatial audio capture apparatus 10 and the one or more additional audio capture devices 12A-C. The signals may be received at the audio processing apparatus 14 in real-time during capture of the audio signals or may be received subsequently for instance via an intermediary storage device. In such examples, the audio processing apparatus 14 may be local to the audio capture environment or may be geographically remote from the audio capture environment in which the audio capture apparatus 10 and devices 12A-C are provided. In some examples, the audio processing apparatus 14 may even form part of the spatial audio capture apparatus 10.

The audio signals received by the audio signal processing apparatus 14 may comprise a multichannel audio input in a loudspeaker format. Such formats may include, but are not limited to, a stereo signal format, a 4.0 signal format, 5.1 signal format and a 7.1 signal format. In such examples, the signals captured by the system of FIG. 1 may have been pre-processed from their original raw format into the loudspeaker format. Alternatively, in other examples, audio signals received by the audio processing apparatus 14 may be in a multi-microphone signal format, such as a raw eight channel input signal. The raw multi-microphone signals may, in some examples, be pre-processed by the audio processing apparatus 14 using spatial audio processing techniques thereby to convert the received signals to loudspeaker format or binaural format.

In some examples, the audio processing apparatus 14 may be configured to mix the signals derived from the one or more additional audio capture devices 12A-C with the signals derived from the spatial audio capture apparatus 10. For instance, the locations of the additional audio capture devices 12A-C may be utilized to mix the signals derived from the additional audio capture devices 12A-C to the correct spatial positions within the spatial audio derived from the spatial audio capture apparatus 10. The mixing of the signals by the audio processing apparatus 14 may be partially or fully-automated.

The audio processing apparatus 14 may be further configured to perform (or allow performance of) spatial repositioning within the spatial audio captured by the spatial audio capture apparatus 10 of the sound sources captured by the additional audio capture devices 12A-C.

Spatial repositioning of sound sources may be performed to enable future rendering in three-dimensional space with free-viewpoint audio in which a user may choose a new listening position freely. Also, spatial repositioning may be used to separate sound sources thereby to make them more individually distinct. Similarly, spatial repositioning may be used to emphasize/de-emphasize certain sources in an audio mix by modifying their spatial position. Other uses of spatial repositioning may include, but are certainly not limited to, placing certain sound sources to a desired spatial location, thereby to get the listeners attention (these may be referred to as audio cues), limiting movement of sound sources to match a certain threshold, and widening the mixed audio signal by widening the spatial locations of the various sound sources. Various techniques for performance of spatial repositioning are known in the art and so will not be in detail herein. One example of a technique which may be used involves calculating the desired gains for a sound source using Vector Base Amplitude Panning (VBAP) when mixing the audio signals in the loudspeaker signal domain. In the case of producing a binaural signal for headphone listening, filtering using head-related-transfer-function (HRTF) filters for the left and right ear based on the desired direction-of-arrival (DOA) for the sound source can be used for sound source positioning.

One issue to be addressed when performing spatial repositioning is the fact that the spatial audio captured by the spatial audio capture apparatus 10 will typically include components derived from the sound source which is being repositioned. As such, it may not be sufficient to simply move the signal captured by an individual additional audio capture device 12A-C. Instead, the components from the resulting sound source should also be separated from the spatial (composite) audio signal captured by the spatial audio apparatus 10 and should be repositioned along with the signal captured by the additional audio capture device 12A-C. If this is not performed, the listener will hear components derived from the same sound source as coming from different locations, which is clearly undesirable.

Various techniques for identification and separation of individual sound sources (both static and moving) from a composite signal are known in the art and so will not be discussed in much detail in this specification. Briefly, the separation process typically involves identifying/estimating the source to be separated, and then subtracting or otherwise removing that identified source from the composite signal. The removal of the identified sound source might be performed in the time domain by subtracting a time-domain signal of the estimated source, or in the frequency domain. An example of a separation method which may be utilized by the audio processing apparatus 14 is that described in pending patent application PCT/EP2016/051709 which relates to the identification and separation of a moving sound source from a composite signal and is hereby incorporated by reference. Another method which may be utilized may be that described in WO2014/147442 which describes the identification and separation of a static sound source and which is also incorporated by reference.

Regardless of how the sound sources are identified, once they have been identified, they may be subtracted or inversely filtered from the composite spatial audio signal to provide a separated audio signal and a remainder of the composite audio signal. Following spatial repositioning (or other modification) of the separated audio signal, the modified separated signal may be remixed back into the remainder of the composite audio signal to form a modified composite audio signal.

Separation of an individual sound source from a composite audio signal may not be particularly straightforward and, as such, it may not be possible in all instances to fully separate an individual sound source from the composite audio signal. In such instances, some components derived from the sound source which is intended for separation may remain in the remainder composite signal following the separation operation.

Figures 2A, 2B:
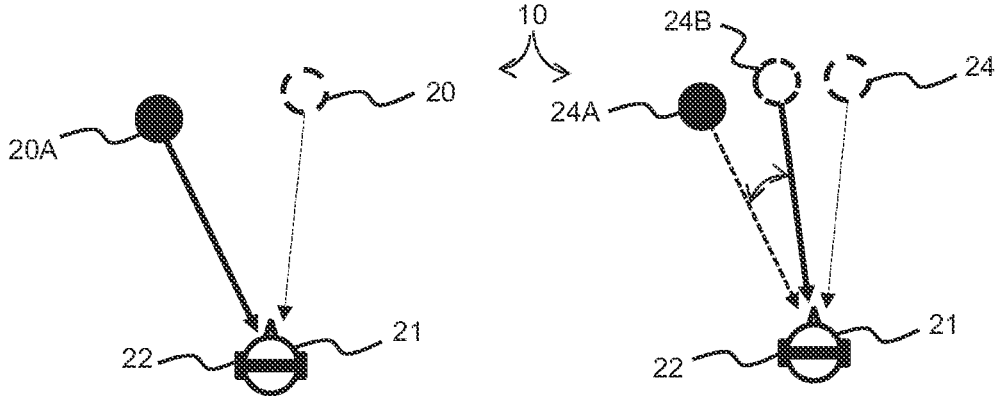
FIGS. 2*a* and 2*b* are schematic views of a moving sound source relative to a user, respectively indicating a successful and non-successful sound separation.

FIG. 2*a* shows schematically the result of a successful separation, in a virtual space 10 comprising a sound source 20 at a first location, the sound source also being shown at a subsequent, second location 20A by virtual of, for example, movement of a user 21 wearing a virtual reality device 22 incorporating a sound output means. From the point of view of the user 21, the perceived position of the sound source 20 will move to the second location 20A as intended.

When the separation is not fully successful, and the separated signal is mixed back into the remainder of the composite audio signal at a repositioned location, the quality of the resulting audio representation that is experienced by the user may be degraded. For instance, in some examples, the user may hear the sound source at an intermediate position between the original location of the sound source and the intended re-positioned location. FIG. 2*b* shows schematically this scenario. In this case, a sound source 24 is not perceived by the user 21 at the correct, second location 24A, but rather at an intermediate location 24B.

In other examples, the user may hear two distinct sound sources, one at the original location and one at the re-positioned location. The effect experienced by the user may depend on the way in which the separation was unsuccessful. For instance, if a residual portion of all or most frequency components of the sound source remain in the composite signal following separation, the user may hear the sound source at the intermediate location. Two distinct sound sources may be heard when only certain frequency components (part of the frequency spectrum) of the sound source remain in the composite signal, with other frequency components being successfully separated. As will be appreciated, either of these effects may be undesirable and, as such, on occasions in which the separation of the audio signal is not fully successful, it may be beneficial to limit the range of spatial repositioning that is available.

Embodiments herein particularly relate to audio scenes for rendering to users for immersive interaction using six degrees-of-freedom, where this suitable. For example, the audio scenes may be provided as part of a virtual reality (VR) or augmented reality (AR) video scene, in which the user may explore the scene by moving. As will be understood, augmented reality (AR) is the merging of real and virtual worlds whereby data is overlaid on the real world view, i.e. to augment the real world view. Six degrees-of-freedom refers to movement comprising yaw, pitch, roll, as well as (translational) left/right, up/down and forward/backward motion. User interaction comprising only yaw, pitch and roll is generally referred to as three degrees-of-freedom (3DoF) interaction. In a six degrees-of-freedom setting, the user is free to walk around, inside and/or through audio objects (and video objects, if provided) with little or no restriction.

It will be appreciated, however, that translational movement of the user away from the capture point, e.g. the corresponding position of the spatial audio capture apparatus 10, will require repositioning of an audio signal that has been captured with one or more of the additional audio capture devices 12A-C.

This is one example application of sound separation; to enable a user to move out seamlessly from the position of the spatial audio capture apparatus 10 with six degrees-of-freedom. Sound captured by one or more of the additional audio capture devices 12A-C is removed from the composite audio signal captured by the spatial audio capture apparatus 10, so that the ambient sound does not contain sound from the repositioned additional audio capture devices 12A-C. Otherwise, this will have an adverse impact on the user experience. If the sound separation is unsuccessful, there may still be an undesirable impact that it would be desirable to avoid or minimize. For example, an undesirable effect may be that sound sources are not moving as they should depending on the listener movement (rotation or translation) if they have not been separated from the composite signal to a sufficient degree. As a result, the user may not perceive changes in the audio scene in response to his movement to a sufficient degree and will therefore not feel fully immersed in the scene or may experience incorrect moving or other undesired aspects in the rendering of the audio scene.

Embodiments herein involve determining regions in a capture space which allow for different types of traversal by rendering sounds within the regions differently. The regions may be associated with respective spatial audio capture apparatuses 10. The regions may comprise an area within a predetermined range of a respective spatial audio capture apparatus 10, for example 5 metres. The regions need not be circular, however, and may be modified using a user interface to make one or more regions of a different size, or shape. The regions may be determined for example based on the mid-point between one or more pairs of spatial audio capture apparatuses 10.

For example, one region may be determined suitable for six degrees-of-freedom traversal and another region may be determined suitable only for three degrees-of-freedom, or for a limited amount of six degrees-of-freedom traversal. The way in which different audio signals are mixed may be different for one or more regions. The determination may be based on whether the audio signal captured by the additional audio capture apparatuses 12A-C can be successfully subtracted or separated from the composite signal from the spatial audio capture apparatus 10, corresponding to the area.

The audio signal captured by an additional audio capture apparatus 12A-C is referred to herein as an individual audio signal.

Embodiments herein may enable a substantially seamless traversal between the different regions, for example a first region allowing six degrees-of-freedom and a second region allowing only three degrees-of-freedom.

Embodiments herein may enable a prior visual or audible indication to be provided when the user, wearing or otherwise carrying a user device for receiving a rendered audio signal from the audio processing apparatus 14 for output via one or more of loudspeakers, headphones and, if provided, one or more display screens for displaying rendered video output, which may be virtual reality (VR) or augmented reality (AR) output. The indication may be provided when the position of the user device in the corresponding virtual space is approaching a boundary between two differing regions, which may be detected if the user device is within a predetermined range of the boundary. Thus, the user will be made aware, for example, that their traversal will switch from, say, six degrees-of-freedom within a first region to three degrees-of-freedom if they enter a second region.

The audio processing apparatus 14 may be configured to determine a measure of success of the separation of the individual audio signal representing the sound source 13A-13C from a composite signal of a given spatial audio capture apparatus 10. This may be performed for each of the sound sources 13A-13C in relation to the given spatial audio capture apparatus 10, or each sound source within a predetermined range of the given audio capture apparatus. The predetermined range may be a set distance, e.g. 5 metres, or it may be dependent on the distance between pairs of spatial audio capture apparatuses, e.g. the midpoint between pairs. In some embodiments, the predetermined range may be set by a user, e.g. using an editing interface. The measure of success may be compared with a predetermined correlation threshold which, if satisfied, indicates successful separation of the individual audio signal. If all individual audio signals from sound sources within the predetermined range can be successfully separated from a composite signal, then the separation for the particular spatial audio capture apparatus 10 is deemed successful. If one individual audio signal cannot be successfully separated, then the separation for the particular spatial audio capture apparatus 10 is deemed only a partial success. If none of the individual audio signals can be successfully separated, then the separation for the particular spatial audio capture apparatus 10 is fully unsuccessful.

In other examples, the measure of separation success may be determined by another entity within the system and may be provided to the audio processing apparatus 14, for instance along with the audio signals.

The measure of success, in certain examples may comprise a determined correlation between a remainder of the composite audio signal and at least one reference audio signal. The reference audio signal may, in some examples, be the separated audio signal. In such examples, the audio processing apparatus 10 may thus be configured to determine a correlation between a portion of the remainder of the composite audio corresponding to the original location of the separated signal and the separated audio signal. A high correlation may indicate that the separation has not been particularly successful (a low degree of success), whereas a low (or no) correlation may indicate that the separation has been successful (a high degree of success). It will thus be appreciated that, in such examples, the correlation (which is an example of the determined measure of success of the separation) may have an inverse relationship with the degree of success of the separation.

In other examples, the reference signal may comprise a signal captured by one of the additional recording devices 12A, for instance the additional recording devices that is associated with the audio source with which the separated signal is associated. This approach may be useful for determining separation success when the separation has resulted in the audio spectrum associated with the sound source being split between the remainder of the composite signal and the separated signal. Once again, the correlation may have an inverse relationship with the degree of success of the separation.

In some examples, both the correlation between the composite audio signal and the separated signal and the correlation between the composite audio signal and the signal derived from the additional recording device may be determined and utilised to determine the separation success. If either of the correlations is above a threshold, it may be determined that the separation has not been fully successful.

The correlation may be determined using the following expression:

$$\text{Correlation}(\tau, n) = \sum_{K=0}^{n} R(k)S(k-\tau)$$

where R(k) and S(k) are the $k^{th}$ samples from remainder of the composite signal and the reference signal respectively, r is the time lag and n is the total number of samples.

The audio processing apparatus 14 may be configured to compare the determined correlation with a predetermined correlation threshold and, if the correlation is a below the predetermined threshold correlation, to determine that the separation has been fully (or sufficiently) successful. Conversely, if the correlation is above the predetermined threshold correlation, the audio processing apparatus 14 may be configured to determine that the separation has not been fully (or sufficiently) successful or, put another way, has been only partially successful.

As an alternative to the expression shown above, the measure of success of the separation, in some examples, may comprise a correlation between a frequency spectrum associated with the remainder of the composite audio signal and a frequency spectrum associated with at least one reference audio signal. If frequency components from the reference audio signal are also present in the remainder of the composite audio signal, it can be inferred that the separation has not been fully successful. In contrast, if there is no correlation between frequency components in the separated audio signal and the remainder of the composite audio signal it may be determined that the separation has been fully successful. As described above, the at least one reference audio signal may comprise one or both of the separated audio signal and a signal derived from one of the additional recording devices.

In other examples, however, the measure of success of the separation may comprise a correlation between a remainder of composite audio signal and a component of a video signal corresponding to the composite audio signal. For instance, in examples in which the sound source is derived from a person talking, the audio processing apparatus 14 may determine whether the remainder of the composite audio signal includes components having timing which correspond to movements of the mouth of the person from which the sound source is derived. If such audio components do exist, it may be determined that the separation has not been fully successful, whereas if such audio components do not exist it may be determined that the separation has been fully successful.

As will be appreciated, in all of the examples described above, the determined correlation has an inverse relationship with a degree of success of the separation.

If individual audio signals from the additional audio capture devices 12A-C (which may be within a predetermined range of the spatial audio capture apparatus 10) can be successfully separated from its composite signal, using the methods above, then the separation for this spatial audio capture apparatus is determined successful.

When separation is successful, we have an accurate representation of the so-called room impulse responses (RIR) from the additional audio capture devices 12A-C to the particular spatial audio capture apparatus 10. This means that each individual audio signal from the additional audio capture devices 12A-C can be subtracted away from the composite audio signal from the spatial audio capture apparatus 10. Volumetric audio rendering may be implemented within a region around the spatial audio capture apparatus 10 using, for example, the individual audio signals (known as the dry signals), the dry signals processed (using convolution) with the room impulse response (RIR) (known as the wet signals), and the diffuse ambience residuals of the composite audio signal after separation.

Thus, certain definitions given below apply herein.

A room impulse response (RIR) is the transfer function of the capture space between a sound source, which in present embodiments may be a close-up microphone recorded signal, and a microphone, which in present embodiments may be the signal recorded at a particular spatial audio capture apparatus 10. Determination of the RIR is disclosed in WO2017/129239 and is the frequency domain room response $h_{f,n,p}$ of each source, fixed within each time frame n, which may be expressed as $$h_{f,n,p}=[h_{f,n,1}, \ldots, h_{f,n,M}]^T$$

where h is the spatial response, f is the frequency index, n is the frame index, and p is the audio source index.

A dry signal is an unprocessed signal captured by an individual, e.g. close-up, microphone or other audio capture device.

A wet signal is a processed signal, generated by applying the room impulse response to a particular dry signal. This usually involves convolution.

An ambient signal is the signal remaining after separation (removal) of a wet signal from a composite signal.

When separation is unsuccessful, for example when one or more of the individual audio signals from the additional audio capture devices 12-C cannot be subtracted away from the composite audio signal from the spatial audio capture apparatus 10, the room impulse responses (RIRs) are inaccurate and the above rendering technique cannot be used without producing unwanted artefacts. A number of options are possible for rendering audio in the region around the spatial audio capture apparatus 10 in this situation.

For example, volumetric audio rendering is possible using the dry audio signals from the additional audio capture devices 12A-C only. Alternatively, only three degrees-of-freedom playback may be permitted in the region associated with the spatial audio capture apparatus 10. Only head rotation, for example, may be supported. Alternatively still, the room impulse response (RIR) from another spatial audio capture apparatus 10 may be used to create volumetric audio, for example by substituting this and the diffuse residual from the other spatial audio capture apparatus for the current one. A user interface may be employed to enable a producer or mixer to select which method to use for different scenarios.

Example embodiments will now be described graphically.

Figure 3:
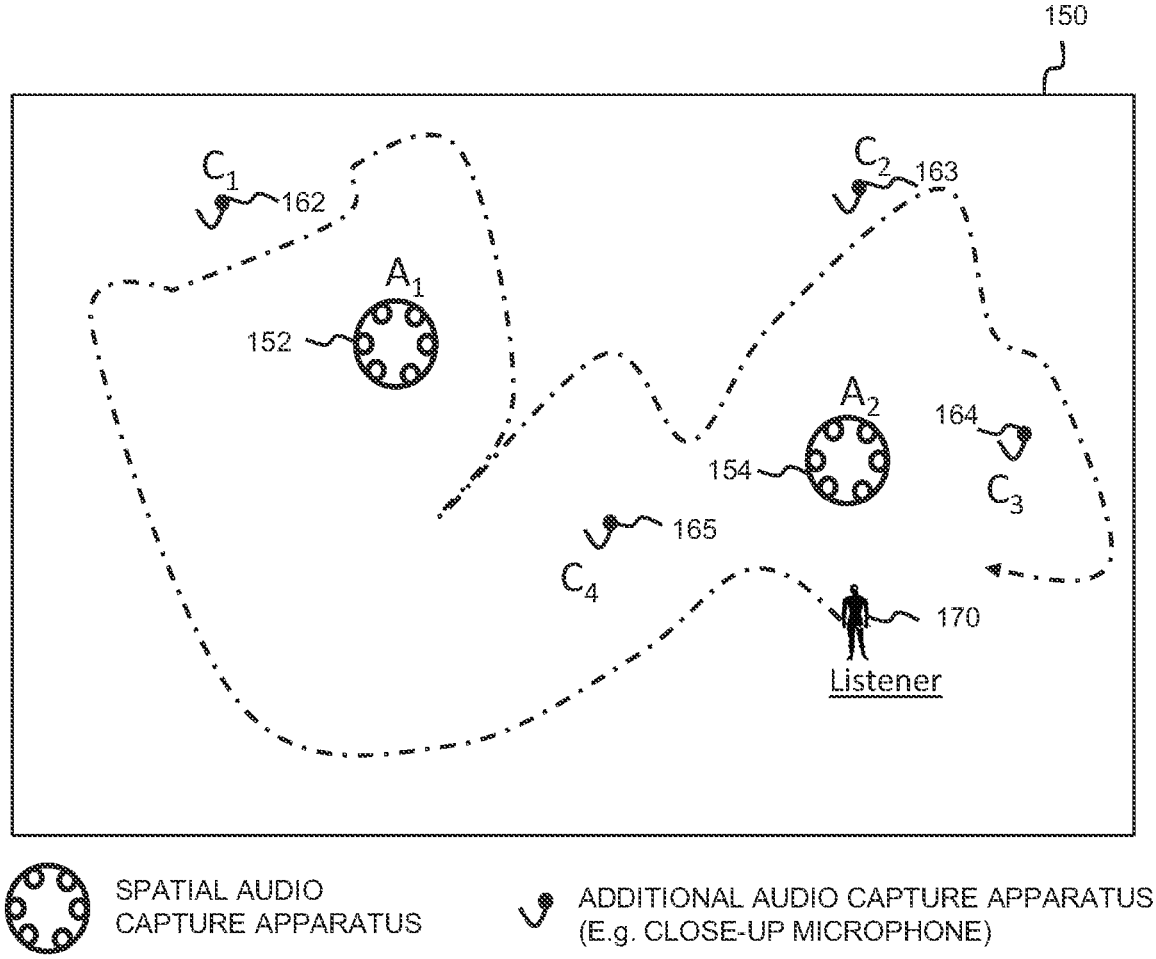
FIG. 3 is a schematic plan view of a capture space in which successful sound separation permits a user wearing a user device to traverse the corresponding virtual space using six degrees-of-freedom, in accordance with various examples described herein.

FIG. 3 is a schematic plan view of a capture space 150 in which a user 170 is shown superimposed in a location of the corresponding virtual space derived from the capture space. The user 170 is assumed to be wearing or otherwise carrying a virtual reality (VR) or augmented reality (AR) device which includes loudspeakers or headphones for perceiving sound. Within the capture space 150 are provided first and second spatial audio capture apparatuses (A1, A2) 152, 154 at separate spatial locations. A different number may be provided in other embodiments. Each spatial audio capture apparatus 152, 154 may generate a respective spatial audio signal, namely first and second composite audio signals derived from one or more sound sources C1-C4 within the capture space 150. The composite audio signals are produced using the plural microphones shown in FIG. 1 as elements 101A, 101B.

As shown, each of the sound sources C1-C4 carries a respective additional audio capture device 162-165, which may be a close-up microphone. Each such additional audio capture device 162-165 produces an individual audio signal.

The first and second composite audio signals and the individual audio signals from the spatial audio capture apparatuses 152, 154 and from the additional audio capture devices 162-165 is provided to the audio processing apparatus 14 for mixing and rendering to the virtual reality device carried by the user 170, dependent on their location within the virtual space which may change over time to indicate movement.

The audio processing apparatus 14 may operate by determining, for each spatial audio capture apparatus 152, 154, whether the individual audio signals from the sound sources C1-C4, received from the additional audio capture devices 162-165, can be successfully separated from the respective first and second composite audio signals. If all individual audio signals from the sound sources C1-C4 can be successfully separated from the first composite audio signal, then separation is considered successful for the first spatial audio capture apparatus (A1) 152. Similarly, if all individual audio signals from the sound sources C1-C4 can be successfully separated from the second composite audio signal, then separation is considered successful for the first spatial audio capture apparatus (A2) 154.

In some embodiments, the determination of separation success may be determined only for sound sources C1-C4 within a predetermined range of the first and second spatial audio capture apparatuses (A1, A2) 152, 154. For example, so long as those sound sources C1-C4 within this range can have their individual audio signals successfully separated from the composite signal, then separation can be considered successful for the particular spatial audio capture apparatus (A1, A2) 152, 154. The range may, for example, be a predetermined distance of, say, 5 metres from the spatial audio capture apparatus (A1, A2) 152, 154 or it may be a mid-point between pairs of the spatial audio capture apparatuses.

In the FIG. 3 scenario, we assume that the additional audio signals from the additional audio capture devices 162-165 of objects C1-C4 can be successfully separated from each of the first and second composite audio signals from the first and second spatial audio capture apparatuses (A1, A2) 152, 154. The room impulse response (RIR) can be considered an accurate representation of the signal transformation from each of the additional audio capture devices 162-165 to each of the first and second spatial audio capture apparatuses (A1, A2) 152, 154, and volumetric audio rendering may be implemented accurately within the regions around each of the first and second spatial audio capture apparatuses. The volumetric audio rendering may use the individual audio signals, the wet versions of the individual audio signals (generated after applying them to the RIR) and the diffuse ambient residual signal of the first and second spatial audio capture apparatuses (A1, A2) 152, 154 after separation.

Consequently, the user 170 has full freedom of movement with six degrees-of-freedom within the space, as indicated by the path line 180, regardless of whether the user is in the region closest to the first or the second spatial audio capture apparatuses (A1, A2) 152, 154.

This result may not be possible to achieve in all scenarios, however.

Figure 4:
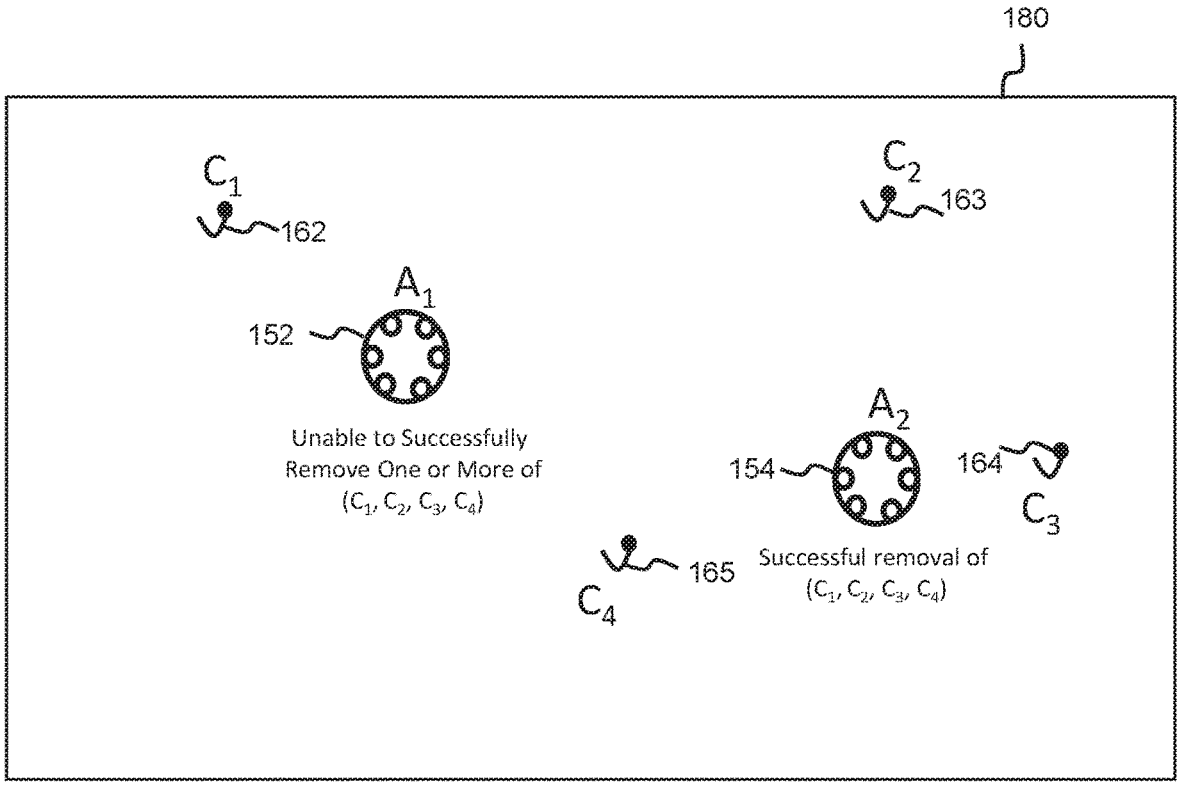
FIG. 4 is a schematic plan view of a capture space in which sound separation is successful for only a subset of spatial audio capture apparatuses, in accordance with various examples described herein.

FIG. 4 is a schematic plan view of another capture space 180 having the same arrangement of first and second spatial audio capture apparatuses (A1, A2) 152, 154 at separate spatial locations for generating a respective spatial audio signal, namely first and second composite audio signals derived from one or more sound sources C1-C4 within the capture space 150. The composite audio signals are produced using the plural microphones shown in FIG. 1 as elements 101A, 101B. Each of the sound sources C1-C4 carries a respective additional audio capture device 162-165, which may be a close-up microphone. Each such additional audio capture device 162-165 produces an individual audio signal.

In this scenario, we assume that separation is successful only for the second spatial audio capture apparatus (A2) 154 and not for the first spatial audio capture apparatus (A1) 152. It may be, for example, that the individual audio signal from sound source C4 cannot be successfully separated from the first composite audio signal. Consequently, a user may have full freedom of movement with six degrees-of-freedom when closest to the second spatial audio capture apparatus (A2) 154, receiving volumetric rendered audio, whereas the audio may be rendered differently when closest to the first spatial audio capture apparatus (A1) 152, as indicated previously. For example, volumetric audio rendering is possible using the dry audio signals from the sound sources C1-C4. Alternatively, only three degrees-of-freedom (3DOF) playback may be permitted in the region associated with the first spatial audio capture apparatus (C1) 152. Only head rotation, for example, may be supported. Alternatively still, the room impulse responses (RIRs) and diffuse residual from the second spatial audio capture apparatus 154 may be used to create volumetric audio by substituting the RIRs and diffuse residual of the first spatial audio capture apparatus 152. A user interface may be employed to enable a producer or mixer to select which method to use for different scenarios.

Figure 5:
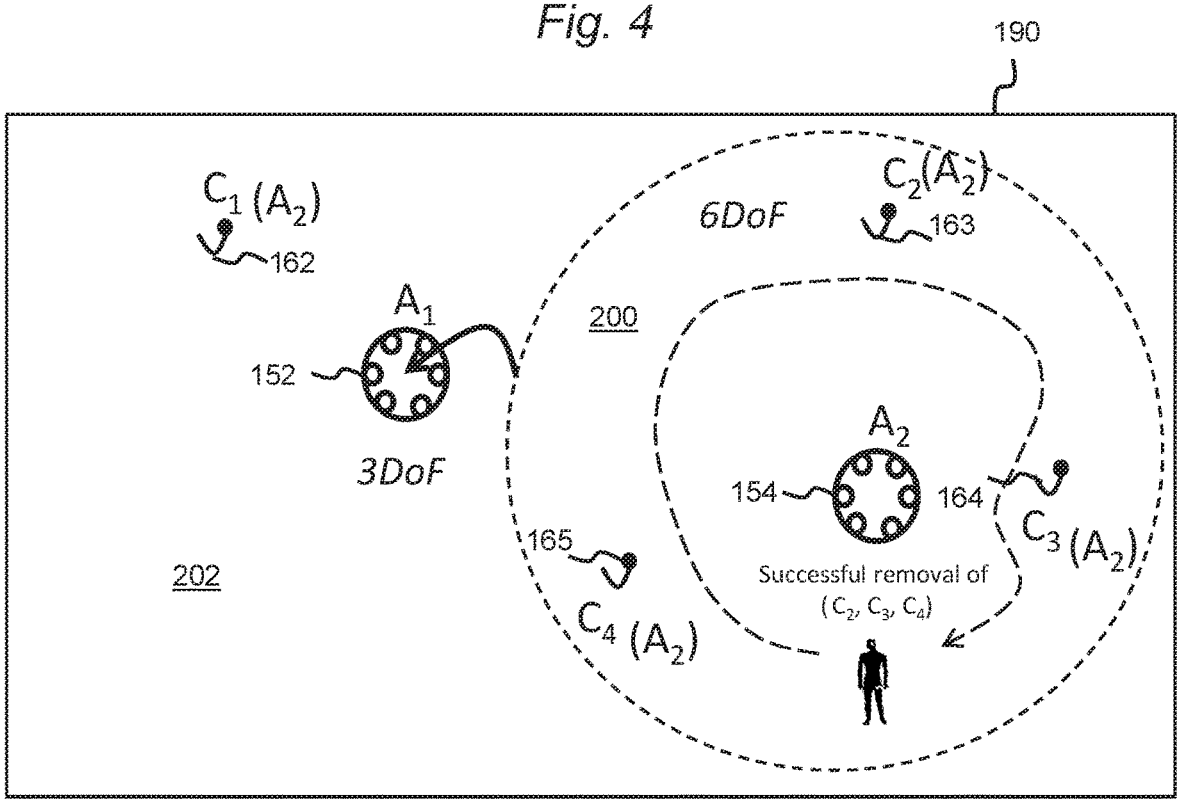
FIG. 5 is a schematic plan view of the FIG. 4 capture space in which first and second regions are defined based on the determination of sound separation, in accordance with various examples described herein.

FIG. 5 is a schematic visualization 190 of another scenario, having the same arrangement as FIGS. 3 and 4. In this example, like FIG. 4, we assume that separation is only successful for the second spatial audio capture apparatus (A2) 154 and not for the first spatial audio capture apparatus (A1) 152. The second spatial audio capture apparatus (A2) 154 has a predefined region 200 defined around it and individual audio signals from sound sources C2-C4 within said region are tested for successful separation. Consequently, a user 192 may have full freedom of movement with six degrees-of-freedom when within the predefined region 200, receiving volumetric rendered audio. Volumetric audio rendering may be implemented within the region 200 using, for example, the individual audio signals (known as the dry signals), the dry signals processed (using convolution) with the room impulse response (RIR) (known as the wet signals), and the diffuse ambience residuals of the composite audio signal after separation. The audio may be rendered differently when the user 192 is in an outside zone 202. This different audio rendering may use any of the examples given above. Here, we determine that only three degrees-of-freedom is permitted when the user moves to the outside zone 202. For example, from the user's perspective, the audio (and possibly the video rendering, if provided) may traverse or teleport to the location of the first spatial audio capture apparatus (A1) 152. This is indicated by the arrow 204. From this location, the user 192 may only experience audio based on the first composite audio signal from the first spatial audio capture apparatus (A1) 152 with only head rotation supported.

In some embodiments, a user interface may provide an automatic indication to the user device, e.g. a virtual reality (VR) device incorporating audio and video output devices, that they are at, or approaching, a boundary between different regions such as those regions 200, 202 shown in FIG. 5 above. Here, we assume that the user interface is provided in video form, but indications can be provided using audio and/or haptics also.

FIGS. 6*a*-6*c* show three different stages of translational traversal of a user 192 within the FIG. 5 space. We assume the same determination of sound separation success, in that the first spatial audio capture apparatus (A1) 152 is deemed unsuccessful and the second spatial audio capture apparatus (A2) 154 is deemed successful. The left-hand images 220A-220C show the traversal of the user 192 with the user's field-of-view (FOV) 225. The right hand images 230A-230C show the video user interface displayed to the virtual reality (VR) device, corresponding to each traversal position.

Referring first to FIG. 6*a*, the user 192 is within the region 200 associated with the second spatial audio capture apparatus (A2) 154, e.g. a predetermined 5 metre region. Thus, volumetric audio is output to the virtual reality (VR) device and six degrees-of-freedom traversal is permitted such that the volumetric audio will move according to the user's traversal within this region 200. The video user interface 230A indicates that the sound source (C4) 165 is visible within the user's field-of-view (FOV) 225 and an indicator 252 towards the top-edge tells the user that six degrees-of-freedom traversal is permitted.

Referring to FIG. 6*b*, the user 102 has moved to the boundary edge of the region 200. Thus, volumetric audio is still output to the virtual reality (VR) device and six degrees-of-freedom traversal is still permitted such that the volumetric audio will change according to the user's traversal within this region 200. That is, the audio changes to reflect the user's movement, for example, a volume of a sound source dropping if the user moves away from the audio source, increasing in volume if the user moves towards the audio source, and moving in space to reflect translational or rotational movement. Furthermore, control of the dry to wet ratio of a sound source may be used to render the distance to a sound source; with the dry to wet ratio being largest close to a source and vice versa. It is noted that the above changes are applied for the sound objects only, using the dry and wet signals. The diffuse ambiance may in some embodiments be rendered as such regardless of user position. However, head rotation may be taken into account for the diffuse ambiance, so that is stays at a fixed orientation with regard to the world coordinates. However, because the user 102 is at the edge of the region 200, for example within a 0.5 metre threshold of the edge, and because the field-of-view (FOV) 225 is directed towards the outer region 202, the video user interface 230B indicates the consequence of moving onwards in this direction. Particularly, the video user interface 230B shows that the user 102 will traverse directly to the position of the first spatial audio capture apparatus 254, i.e. by teleportation, if they continue in the same direction. Other forms of indication may be used. In this way, the user 102 may select to change direction if the wish to retain six degrees-of-freedom motion.

Referring to FIG. 6*c*, the user 102 has moved outside of the region 200 and hence, the video user interface 230C indicates that they have jumped to the location of the first spatial audio capture apparatus 254. The user's field-of-view (FOV) 225 has rotated also, such that they can see the sound source (C4) 165 from the opposite side. The indicator 252 changes to a different form 256, indicative that only three degrees-of-freedom is now permitted, meaning that translational movement will not occur in the virtual space and only rotational movement will be result, regardless of real-world movement. The user 102 may return to the six degrees-of-freedom region 200 by selecting a further indication 260 provided in the top-left area of the video user interface 230C, or by some other predetermined gesture. The further indication 260 may be selected by the user pointing to it, or by using a short-cut button on a control device, or by some other selection means. The predetermined gesture may, for example, comprise the user moving their head forwards, or similar. Whichever selection means is employed, the user 102 may easily move back to the other region 200. Where more than two regions 200, 202 are present, more than one such further indication 260 may be presented and/or two or more different gestures may be detected to determine which region is returned to. Only the nearest six degrees-of-freedom region may be indicated, in some embodiments.

Figure 7:
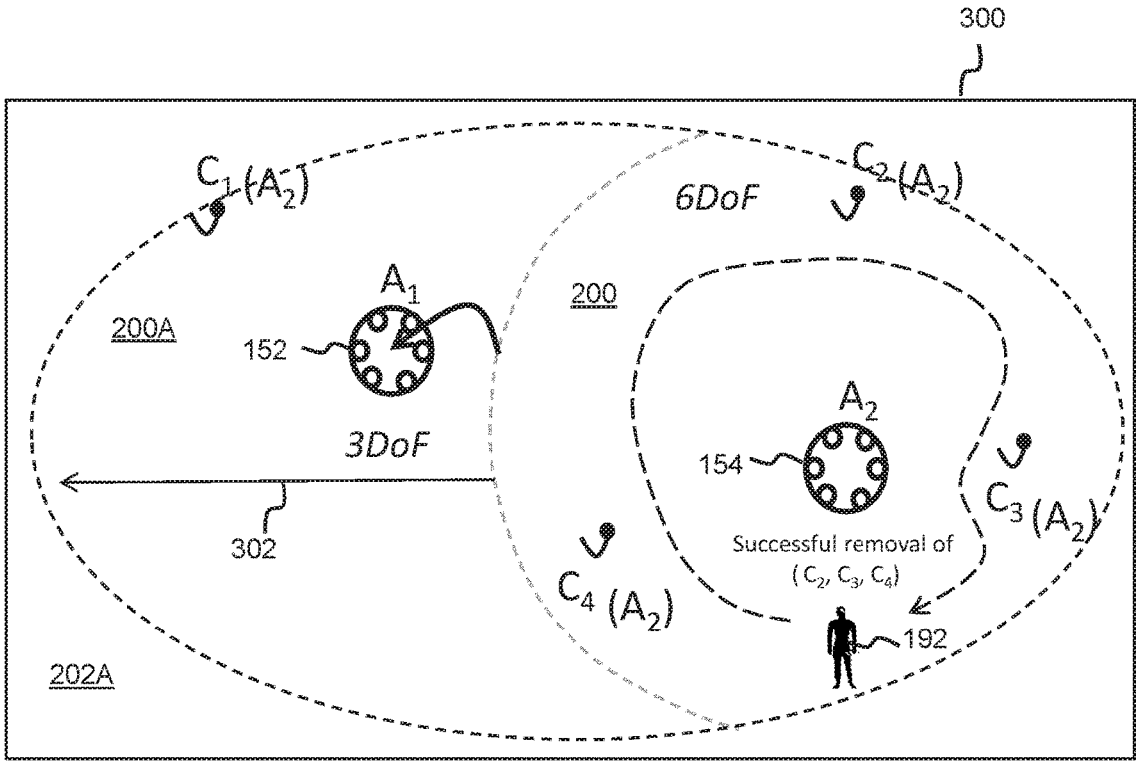
FIG. 7 shows a editing user interface view for permitting a user to modify one or more regions associated with a spatial audio capture apparatus, in accordance with various examples described herein.

Referring to FIG. 7, in some embodiments a graphical user interface (GUI) 300 may be provided as part of an audio scene editor application which may form part of, or is separate from, the audio rendering functionality of the audio processing apparatus 14. The audio scene editor application may permit a director or editor of the audio data (and video data, if provided) to modify the audio scene during or after capture. In the shown example, the scenario shown in FIG. 5 is depicted whereby the zone 200 associated with the second spatial audio capture apparatus 154 may be modified by making it larger. This results in an expanded zone 200A in which movement of the user 192 will receive the volumetric audio rendered as for the second spatial audio capture apparatus 154, even though the user is closer to the first spatial audio capture apparatus 152, which happens to be covered by the expanded zone. This permits a greater area in which six degrees-of-freedom is available to the user. For example, the ambience after separation from the second spatial audio capture apparatus 154 may be used together with the room impulse responses (RIRs) derived from the second spatial audio capture apparatus, such that all objects (C1-C4) 162-165 are rendered with roomification, and the positions of said objects will change as the user's position changes within the region 202A.

In some embodiments, the region 200 may be modified by making it smaller, or a more complex shape (not necessarily circular or oval.)

Modification may be by means of the director or editor selecting the region 202A and dragging an edge of the region leftwards or rightwards. Selection and/or dragging may be received by means of a user input device such as a mouse or trackball/trackpad, and/or by means of inputs to a touch-sensitive display.

Figure 8:
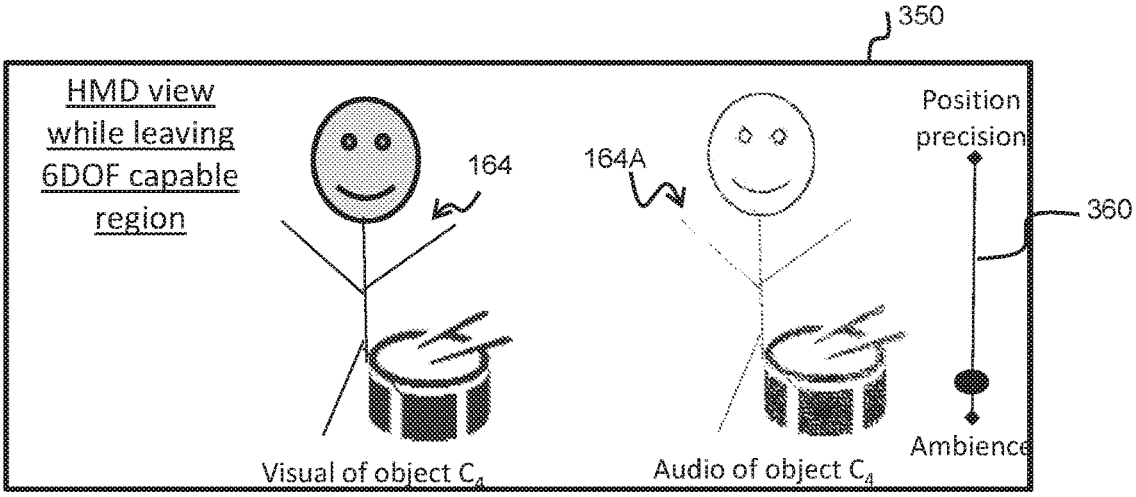
FIG. 8 shows a user interface view for permitting a user to prioritize ambience over position precision, in accordance with various examples described herein.

FIG. 8 shows a video user interface 350 displayed to a virtual reality (VR) device according to another embodiment. It is assumed that the separation success scenario depicted in FIGS. 5 and 6 is the same, in that we assume that separation is successful only for the second spatial audio capture apparatus (A2) 154 and not for the first spatial audio capture apparatus (A1) 152. The video user interface 350 depicts the situation where the user 192 has traversed from the main region 200 to the outer region 202.

In this scenario, traversal between the main region 200 and the outer region 202 does not result in a switch to only three degrees-of-freedom as is the case for the embodiments of FIGS. 6 and 7. Rather, the user 192 is permitted to have six degrees-of-freedom (6DoF) in the outer region 202 but with the audio rendered appropriately. For example, the user may receive audio rendered with an accurate ambience using the composite signal of the first audio capture apparatus (A1) 152, albeit with reduced positional accuracy due to unsuccessful separation. As shown in FIG. 8, a visual representation of the object (C4) 164 may be in a first location but the ambient audio may be rendered in a different location 164A.

A user control 36*o*, provided with the video user interface 350 may permit adjustment on a sliding (or incremental) scale between this preference and, at the other end of the scale, the use of for example only the dry audio signals to render a more accurate position of the audio.

Figure 9:
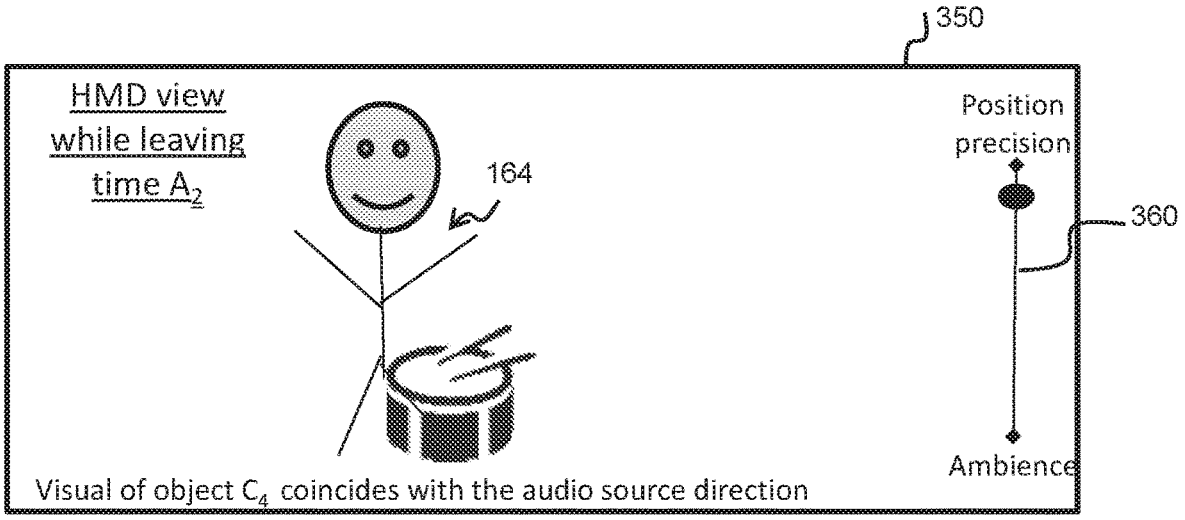
FIG. 9 shows the FIG. 8 user interface view in which position precision is prioritized over ambience, in accordance with various examples described herein.

FIG. 9, for example, shows the result of moving the selector towards the preference of positional accuracy whereby both the visual and audio rendering is at substantially the same location by virtue of employing the dry audio signals in preference of the first audio capture apparatus (A1) 152 ambient signal.

Adjustment of the user control 360, which may be operated by a user in real-time or prior to providing the video and audio data to a user device, enables prioritization of positional accuracy over ambience accuracy. Use of a sliding scale permits a graduated prioritization.

For example, in some embodiments, the ambience may be de-emphasized with lower volume. The smaller the volume of the unsuccessfully separated ambience audio, the lower will be the impact on the changing the perceived direction of arrival (DOA) of the shown audio object (C4) 164. To clarify, if the ambiance is unsuccessfully separated, we can assume that it will slow down the changing of the direction of arrival of an audio object as the object is mixed to the desired position. However, if the ambiance is low volume or successfully separated, it will have little, if any, effect on the spatial position of the sound object because it does not contain any content of the sound object.

Figure 10:
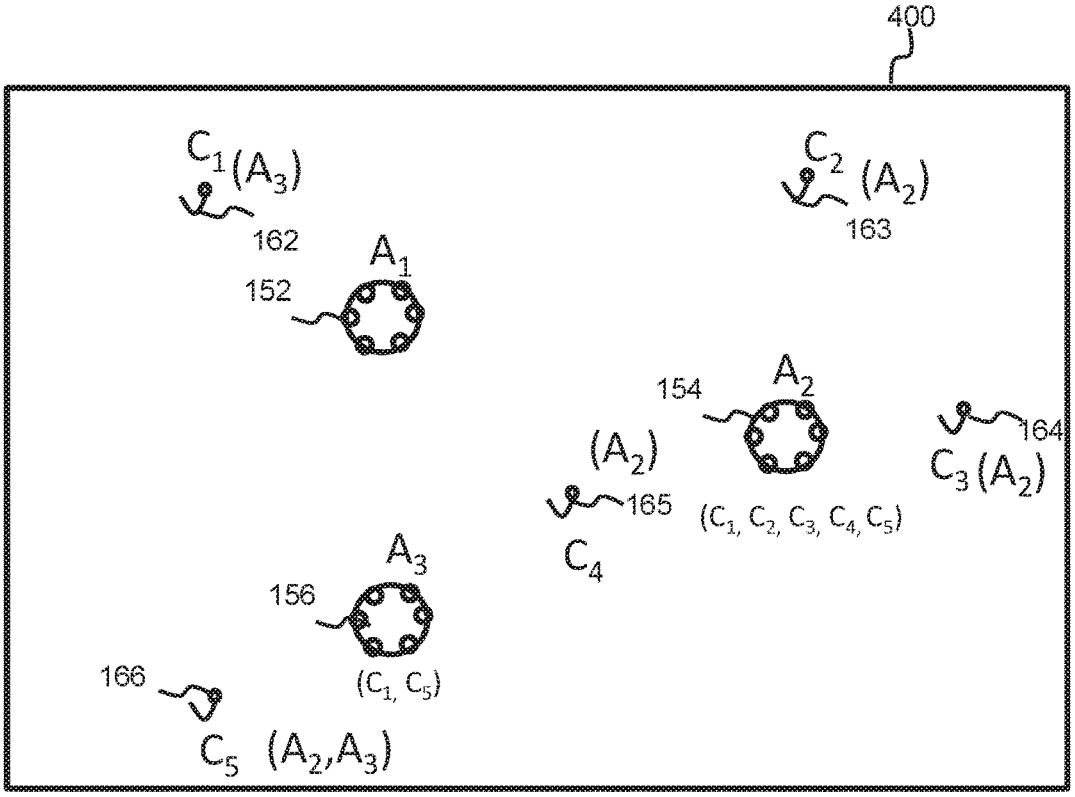
FIGS. 10*a* and 10*b* are schematic plan views of the FIG. 3 capture space in which a further, third spatial audio capture apparatus and a further sound source is present, in accordance with various examples described herein.
Figure 10:
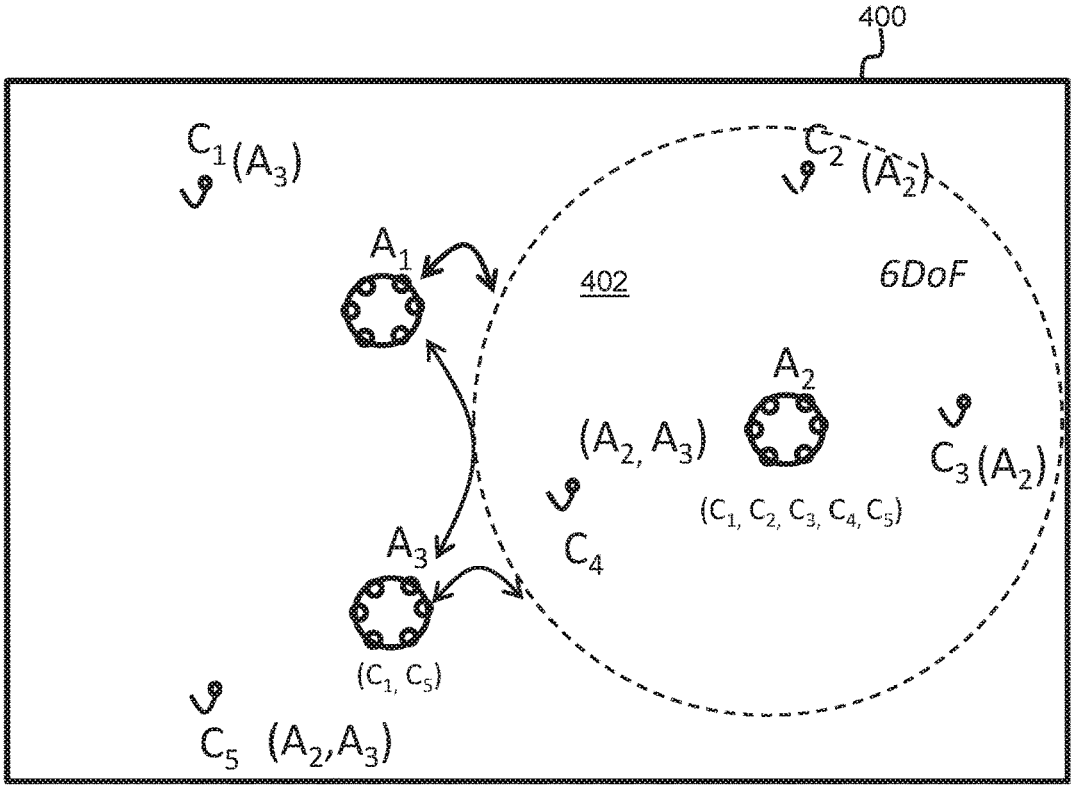

FIGS. 10*a* and 10*b* show further embodiments in which the above embodiments are expanded to comprise first, second and third spatial audio capture apparatuses (A1-A3) 152, 154, 156 and in which first to fifth sound sources (C1-C5) 162-166 are present in the capture space 400. As before, where there is successful separation for each of the first to third spatial audio capture apparatuses (A1-A3) 152, 154, 156 then full volumetric traversal with six degrees-of-freedom may be permitted.

In the example of FIG. 10*a*, however, only the second spatial audio capture apparatus (A2) 154 is successful in terms of being able to separate the individual audio signals from the first to fifth sound sources (C1-C5) 162-166. The first spatial audio capture apparatus (A1) 152 is unsuccessful in terms of separation from any of the individual audio signals from the first to fifth sound sources (C1-C5) 162-166. The third spatial audio capture apparatus (A3) 156 is unsuccessful in terms of separation from the individual audio signals from the second, third and fourth sound sources (C2-C4). As such, the same methods as described above for previous embodiments may be employed.

FIG. 10*b* is a similar scenario in accordance with another embodiment. Due to failure of successful audio separation of all of the first to fifth sound sources (C1-C5) 162-166, the first and third spatial audio capture apparatuses (A1, A3) 152, 156 do not allow six degrees-of-freedom traversal using ambience and room impulse responses derived from them. The arrows indicate that the aforementioned jumping or teleportation to the locations of the first and third spatial audio capture apparatuses (A1, A3) 152, 156 may result from their own locations, and if the user crosses the boundary of the main region 402 associated with the second spatial audio capture apparatus (A2) 154.

Figure 11:
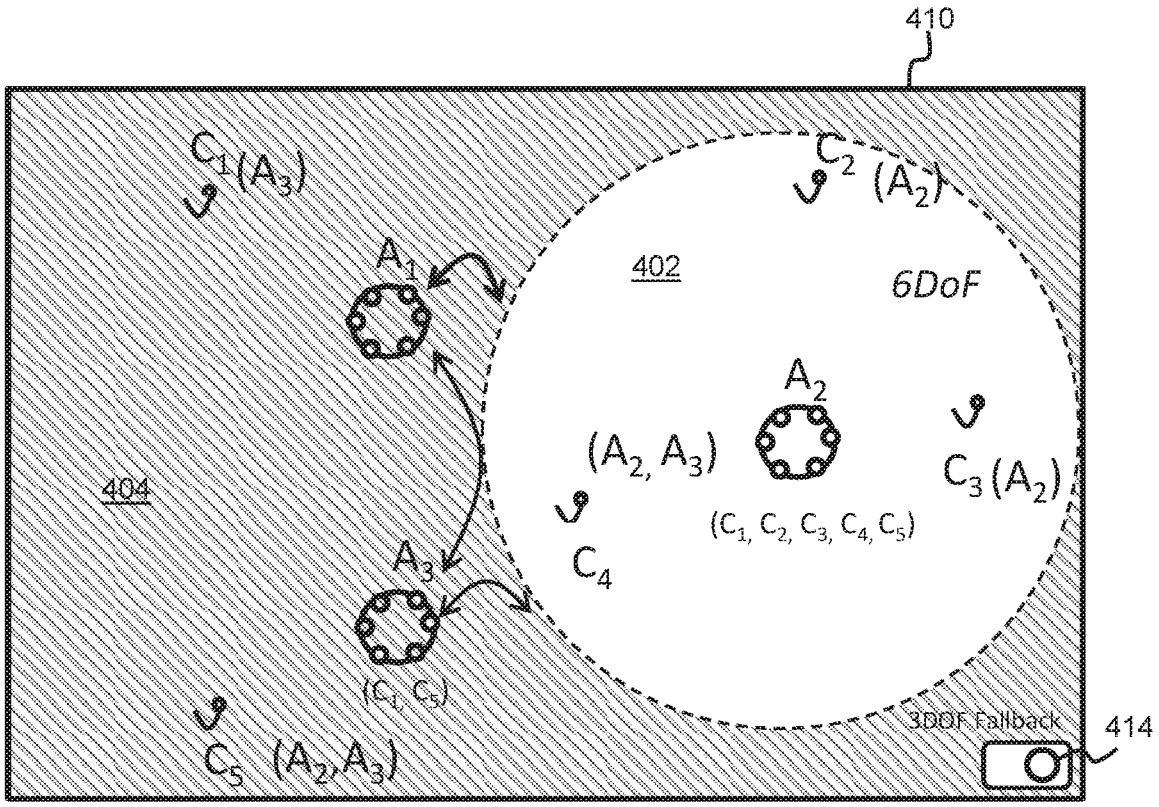
FIGS. 11*a* and 11*b* show the FIG. 10 capture space in which a selector is provided to permit selection of a three degrees-of-freedom or six degrees-of-freedom fallback option, in accordance with various examples described herein.
Figure 11B:
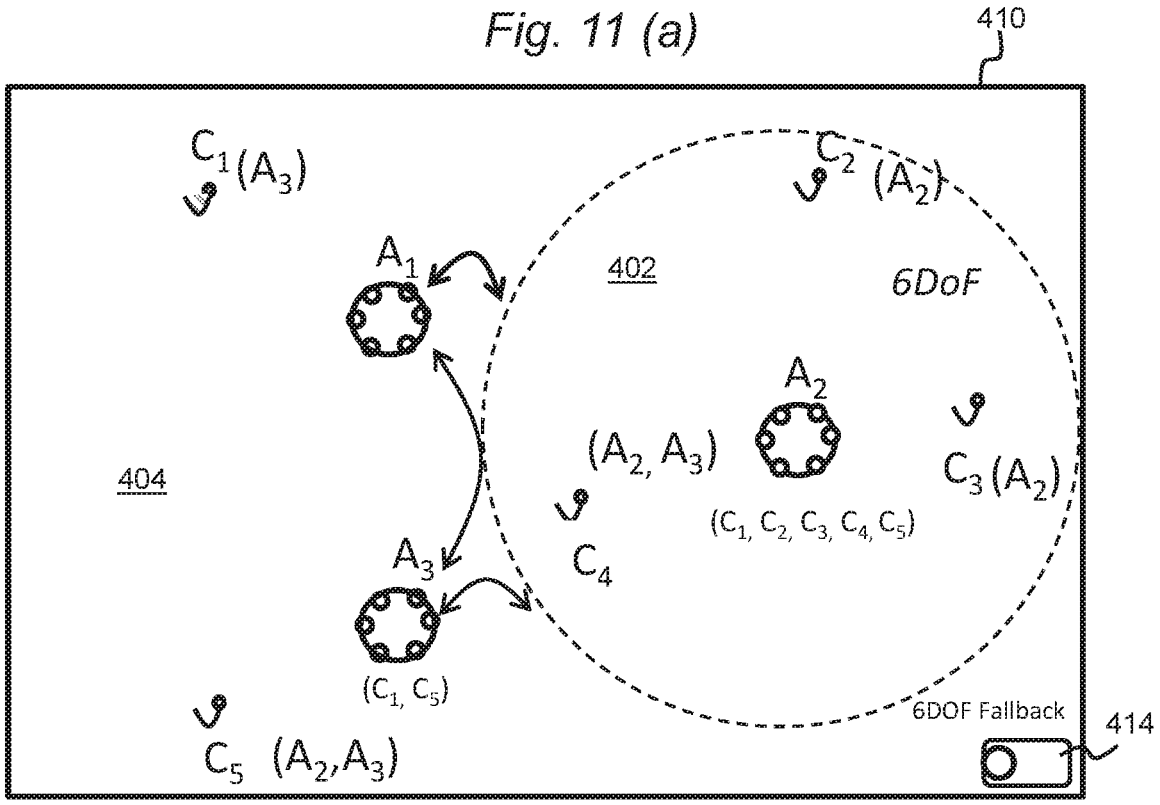

FIGS. 11*a* and 11*b* show a graphical user interface 400 depicting the FIG. 10*b* scenario in which a user may operate a toggle switch 414 to switch between an object rendering fall-back for one or more regions 404 not capable of six degrees-of-freedom rendering due to unsuccessful separation. Said region(s) 404 may be indicated in a different way visually, for example using shading or a different colour from the main region 402. In FIG. 11*a*, the toggle switch 414 selects three degrees-of-freedom fallback, in which case the user traversing outside of the main region 402 will jump to the location of either the first or third spatial audio capture apparatuses (A1, A3) 152, 156. Referring to FIG. 11*b*, the toggle switch 414 selects six degrees-of-freedom fallback, in which case the user traversing outside the main region 402 into the outer region 404 may use the ambience and wet signals processed with the room impulse responses from the second spatial audio capture apparatus (A2) 154. These are made available. The quality of sound will be better in the main region 402 than the outer region 404 but a degree of seamless transition between the two may result despite unsuccessful sound separation.

In the above examples described with reference to FIGS. 1 to 11, the composite signal from which the identified sounds source has been separated is generated by a spatial audio capture apparatus 10. However, it will of course be appreciated that methods and operations described herein may be performed in respect of any audio signal which includes components derived from a plurality of audio sources, for instance a signal derived from one of the additional audio capture devices which happens to include components from two speakers (e.g. because both speakers are in sufficiently close proximity to the capture device).

Although the above examples have been discussed primarily with reference to the modification of characteristics of a separated audio signal, it should be appreciated that various operations described herein may be applied to signals comprising both audio and visual (AV) components.

For instance, spatial repositioning could be applied to the portions of the visual component of the AV signal. For example, the audio processing apparatus 14 may be configured to identify and reposition a visual object in visual components which corresponds to the separated sound source. More specifically, the audio processing apparatus 14 may be configured to segment (or separate) the visual object corresponding to the separated sound source from the remainder of the video component and substitute the background. The audio processing apparatus 14 may be configured subsequently to allow repositioning of the separated visual object based on the determined spatial repositioning parameter for the separated audio signal.

Figure 12:
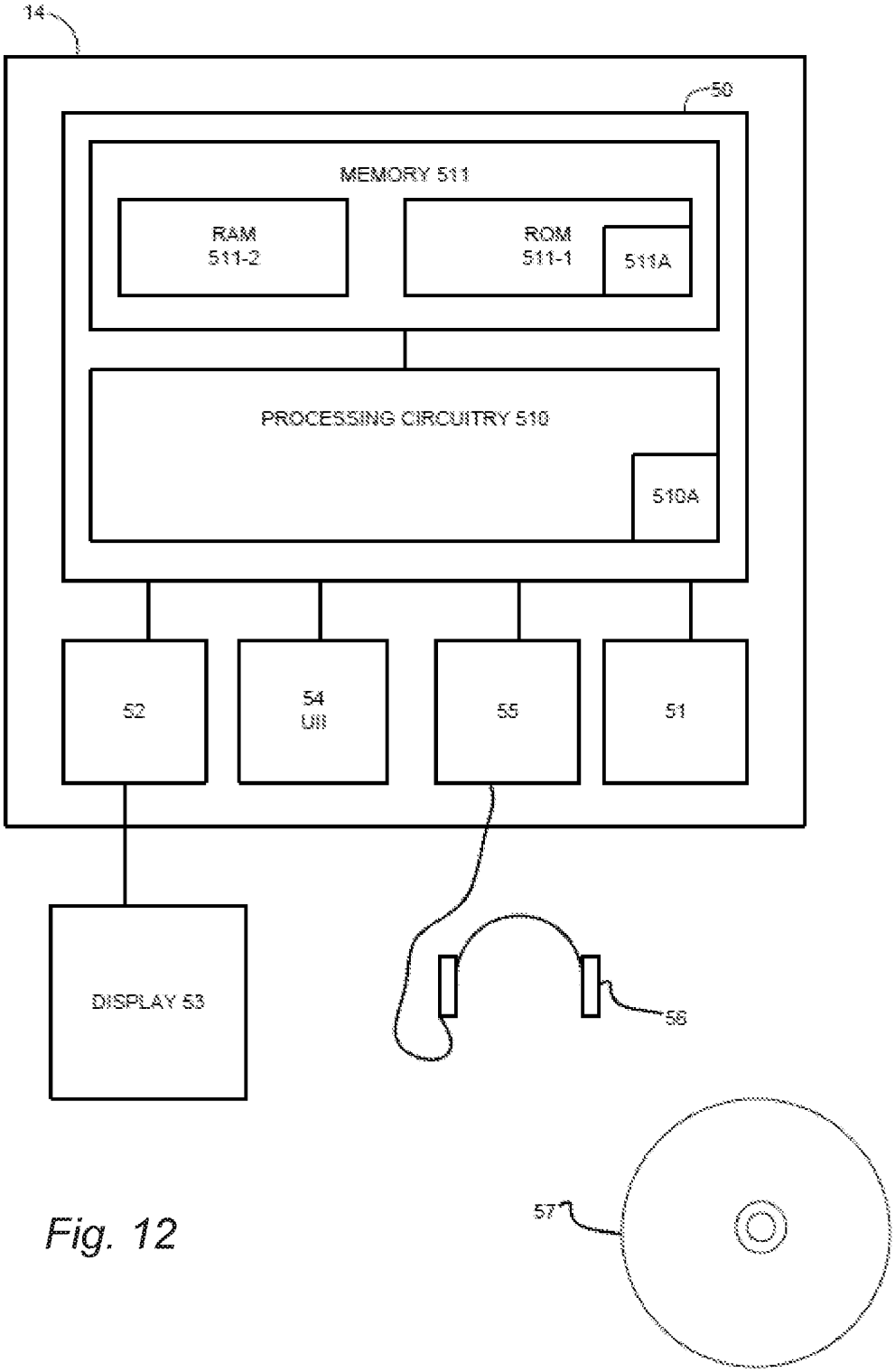
FIG. 12 is a schematic illustration of an example configuration of the audio processing apparatus depicted in FIG. 1.

FIG. 12 is a schematic block diagram illustrating an example configuration of the audio processing apparatus 14 described with reference to FIGS. 1 to 11.

The audio processing apparatus 14 comprises control apparatus 50 which is configured to perform various operations as described above with reference to the audio processing apparatus 14. The control apparatus 50 may be further configured to control the other components of the audio processing apparatus 14.

The audio processing apparatus 14 may further comprise a data input interface 51, via which signals representative of the composite audio signal may be received. Signals derived from the one or more additional audio capture devices 12A-C may also be received via the data input interface 51. The data input interface 51 may be any suitable type of wired or wireless interface. Data representative of the visual components captured by the spatial audio capture apparatus 10 may also be received via the data input interface 51.

The audio processing apparatus 14 may further comprise a visual output interface 52, which may be coupled to a display 53. The control apparatus 50 may cause information indicative of the value of the separated signal modification parameter to be provided to the user via the visual output interface 52 and the display 53. The control apparatus 50 may additionally cause a GUI 30, 32, 34 such as those described with reference to FIGS. 3A, 3B and 3C to be displayed for the user. Video components which correspond to the audio signals may also be caused to be displayed via the visual output interface 52 and the display 53.

The audio processing apparatus 14 may further comprise a user input interface 54 via which user inputs may be provided to the audio processing apparatus 14 by a user of the apparatus.

The audio processing apparatus 14 may additionally comprise an audio output interface 55 via which audio may be provided to the user, for instance via a loudspeaker arrangement or a binaural headtracked headset 56. For instance, the modified composite audio signals may be provided to the user via the audio output interface 55.

The audio processing apparatus 14 may comprise a user position and orientation detection apparatus (for enabling volumetric 6DoF audio rendering.) If for example the audio processing apparatus 14 is a mobile device, the user position and orientation detection apparatus may comprise one or more sensors and software running on the mobile device, such as one or more Kinect type sensors and associated software, as may be found in a Microsoft Hololens device, or the visual sensors and software as may be found in a Google Tango device or other ARCore device. Alternatively, there may be a Kinect sensor somewhere other than the audio processing apparatus 14 for determining user position, and a head tracker carried by the user to determine user head orientation. Alternatively, active markers on the user's body may be tracked by a camera.

Some further details of components and features of the above-described audio processing apparatus 14 and alternatives for them will now be described, primarily with reference to FIG. 12.

The control apparatus 51 may comprise processing circuitry 510 communicatively coupled with memory 511. The memory 511 has computer readable instructions 511A stored thereon, which when executed by the processing circuitry 510 causes the processing circuitry 510 to cause performance of various ones of the operations above described with reference to FIGS. 1 to 11. The control apparatus 51 may in some instances be referred to, in general terms, as "apparatus".

The processing circuitry 510 of any of the audio processing apparatus 14 described with reference to FIGS. 1 to 11 may be of any suitable composition and may include one or more processors 510A of any suitable type or suitable combination of types. For example, the processing circuitry 510 may be a programmable processor that interprets computer program instructions 511A and processes data. The processing circuitry 510 may include plural programmable processors. Alternatively, the processing circuitry 510 may be, for example, programmable hardware with embedded firmware. The processing circuitry 510 may be termed processing means. The processing circuitry 510 may alternatively or additionally include one or more Application Specific Integrated Circuits (ASICs). In some instances, processing circuitry 510 may be referred to as computing apparatus.

The processing circuitry 510 is coupled to the respective memory (or one or more storage devices) 511 and is operable to read/write data to/from the memory 511. The memory 511 may comprise a single memory unit or a plurality of memory units, upon which the computer readable instructions (or code) 511A is stored. For example, the memory 511 may comprise both volatile memory 511-2 and non-volatile memory 511-1. For example, the computer readable instructions 511A may be stored in the non-volatile memory 511-1 and may be executed by the processing circuitry 510 using the volatile memory 501-2 for temporary storage of data or data and instructions. Examples of volatile memory include RAM, DRAM, and SDRAM etc. Examples of non-volatile memory include ROM, PROM, EEPROM, flash memory, optical storage, magnetic storage, etc. The memories in general may be referred to as non-transitory computer readable memory media.

The term 'memory', in addition to covering memory comprising both non-volatile memory and volatile memory, may also cover one or more volatile memories only, one or more non-volatile memories only, or one or more volatile memories and one or more non-volatile memories.

The computer readable instructions 511A may be preprogrammed into the audio processing apparatus 14. Alternatively, the computer readable instructions 511A may arrive at the apparatus 14 via an electromagnetic carrier signal or may be copied from a physical entity 57 such as a computer program product, a memory device or a record medium such as a CD-ROM or DVD. The computer readable instructions 511A may provide the logic and routines that enables the audio processing apparatus 14 to perform the functionality described above. The combination of computer-readable instructions stored on memory (of any of the types described above) may be referred to as a computer program product.

Where applicable, wireless communication capability of the apparatuses 10, 12, 14 may be provided by a single integrated circuit. It may alternatively be provided by a set of integrated circuits (i.e. a chipset). The wireless communication capability may alternatively be a hardwired, application-specific integrated circuit (ASIC).

As will be appreciated, the apparatuses 10, 12, 14 described herein may include various hardware components which may not have been shown in the Figures. For instance, the audio processing apparatus 14 may in some implementations comprise a portable computing device such as a mobile telephone or a tablet computer and so may contain components commonly included in a device of the specific type. Similarly, the audio processing apparatus 14 may comprise further optional software components which are not described in this specification since they may not have relevant to the main principles and concepts described herein.

Figure 13:
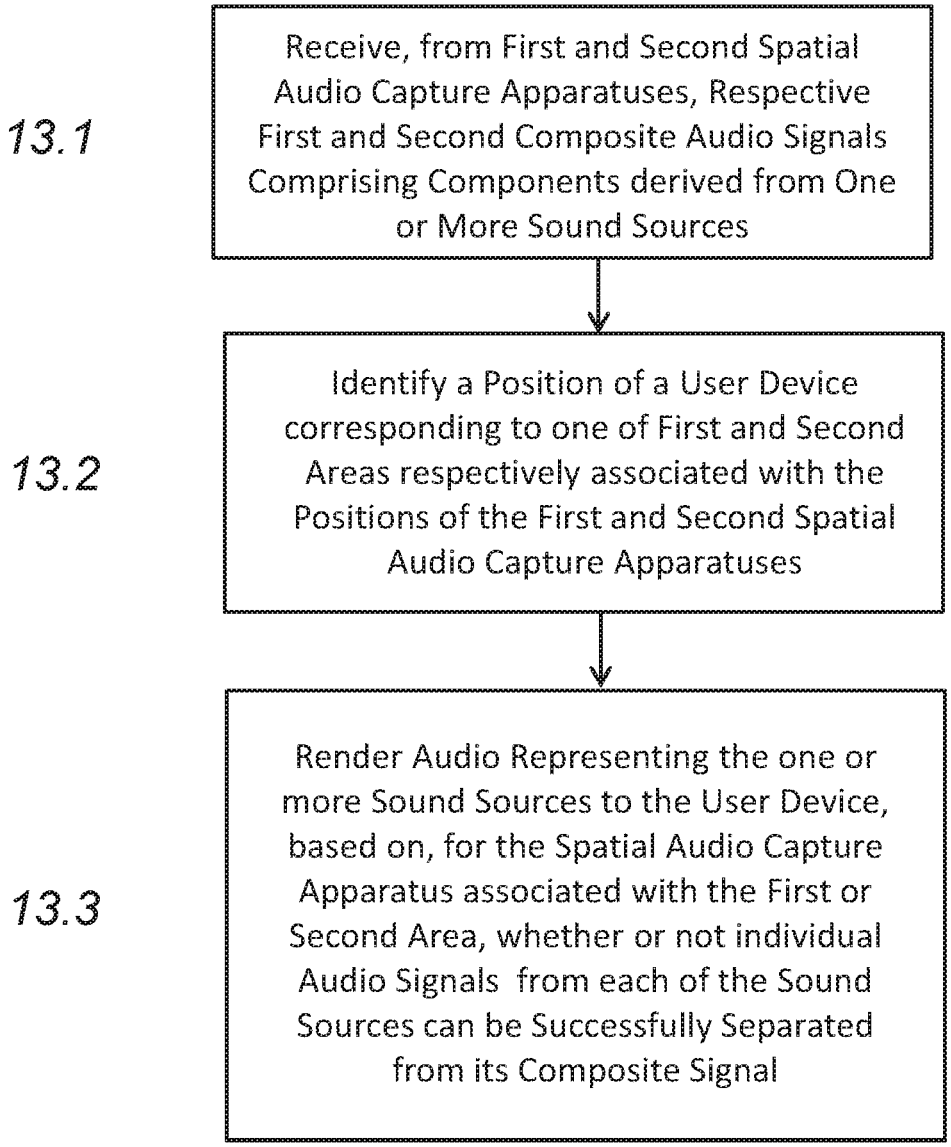
FIG. 13 is a flow diagram showing processing operations performed by the audio processing apparatus depicted in FIGS. 1 and 12, in accordance with various examples described herein.

FIG. 13 is a flow diagram illustrating processing operations that may be performed by the audio processing apparatus 14, for example by software, hardware or a combination thereof, when run by the processor of said apparatus. Certain operations may be omitted, added to or changed in order.

A first operation 13.1 comprises receiving, from first and second spatial audio capture apparatuses, respective first and second composite audio signals comprising components derived from one or more sound sources in a capture space.

A second operation 13.2 comprises identifying a position of a user device corresponding to one of first and second areas respectively associated with the positions of the first and second spatial audio capture apparatuses.

A third operation 13.3 comprises rendering audio representing the one or more sound sources to the user device, the rendering being based on, for the spatial audio capture apparatus associated with the identified first or second area, whether or not individual audio signals from each of the one or more sound sources can be successfully separated from its composite signal.

The examples described herein may be implemented in software, hardware, application logic or a combination of software, hardware and application logic. The software, application logic and/or hardware may reside on memory, or any computer media. In an example embodiment, the application logic, software or an instruction set is maintained on any one of various conventional computer-readable media. In the context of this document, a "memory" or "computer-readable medium" may be any media or means that can contain, store, communicate, propagate or transport the instructions for use by or in connection with an instruction execution system, apparatus, or device, such as a computer.

Reference to, where relevant, "computer-readable storage medium", "computer program product", "tangibly embodied computer program" etc., or a "processor" or "processing circuitry" etc. should be understood to encompass not only computers having differing architectures such as single/multi-processor architectures and sequencers/parallel architectures, but also specialised circuits such as field programmable gate arrays FPGA, application specify circuits ASIC, signal processing devices and other devices. References to computer program, instructions, code etc. should be understood to express software for a programmable processor firmware such as the programmable content of a hardware device as instructions for a processor or configured or configuration settings for a fixed function device, gate array, programmable logic device, etc.

As used in this application, the term 'circuitry' refers to all of the following: (a) hardware-only circuit implementations (such as implementations in only analogue and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

If desired, the different functions discussed herein may be performed in a different order and/or concurrently with each other. Furthermore, if desired, one or more of the above-described functions may be optional or may be combined.

Although various aspects are set out in the independent claims, other aspects comprise other combinations of features from the described embodiments and/or the dependent claims with the features of the independent claims, and not solely the combinations explicitly set out in the claims. It is also noted herein that while the above describes various examples, these descriptions should not be viewed in a limiting sense. Rather, there are several variations and modifications which may be made without departing from the scope of the present invention as defined in the appended claims.

The invention claimed is:

1. An apparatus, comprising:

at least one processor; and at least one memory including computer program code;

the at least one memory and the computer program code configured to, with the at least one processor, cause the apparatus at least to perform:

receiving, from a first spatial audio capture apparatus, a first composite audio signal comprising components derived from one or more sound sources in a capture space;

identifying a position of a user device in relation to the first spatial audio capture apparatus; and responsive to the position of the user device corresponding to a first area associated with the position of the first spatial audio capture apparatus, rendering audio representing the one or more sound sources to the user device, the rendering being performed differently dependent on whether or not individual audio signals from each of the one or more sound sources can be successfully separated from the first composite signal, wherein successful separation is determined by calculating, for each individual audio signal, a measure of success for the separation and by determining whether the measure of success meets a predetermined success threshold, wherein the rendering audio is performed such that the measure of success is calculated using one or more of:

a correlation between a remainder of the composite audio signal and at least one reference audio signal;

a correlation between a frequency spectrum associated with the remainder of the composite audio signal and a frequency spectrum associated with a reference audio signal; and a correlation between a remainder of composite audio signal and a component of a video signal corresponding to the composite audio signal.

2. The apparatus of claim 1, wherein the rendering is performed differently dependent on whether or not individual audio signals from all sound sources within a predetermined range of the first spatial audio capture apparatus, associated with the identified first area, can be successfully separated from its composite audio signal.

3. An apparatus, comprising:

at least one processor; and at least one memory including computer program code;

the at least one memory and the computer program code configured to, with the at least one processor, cause the apparatus at least to perform:

receiving, from a first spatial audio capture apparatus, a first composite audio signal comprising components derived from one or more sound sources in a capture space;

identifying a position of a user device in relation to the first spatial audio capture apparatus;

responsive to the position of the user device corresponding to a first area associated with the position of the first spatial audio capture apparatus, rendering audio representing the one or more sound sources to the user device, the rendering being performed differently dependent on whether or not individual audio signals from each of the one or more sound sources can be successfully separated from the first composite signal, wherein successful separation is determined by calculating, for each individual audio signal, a measure of success for the separation and by determining whether the measure of success meets a predetermined success threshold;

receiving from a second spatial audio capture apparatus, a second composite audio signal comprising components derived from the one or more sound sources in the capture space; and identifying the position of the user device as corresponding to the first area or a second area associated with the second spatial audio capture apparatus, wherein the rendering audio is performed such that if the one or more sound sources can be successfully separated from the first but not the second composite audio signal, the rendering is performed differently for the first and second areas.

4. The apparatus of claim 3, wherein the memory and computer program code are further configured such that the rendering audio is performed such that, for a user device position within the first area, volumetric audio rendering is performed in such a way that a detected change of user device position within the first area results in a change in position of the audio signal for the one or more of the sound sources to create the effect of user device movement.

5. The apparatus of claim 4, wherein the memory and computer program code are further configured such that the rendering audio is performed such that detected translational and rotational changes of user device position result in a substantially corresponding translational and rotational change in position of the audio signal for the one or more sound sources.

6. The apparatus of claim 4, wherein the memory and computer program code are further configured such that the rendering audio is performed such that the volumetric rendering is performed using a mix comprising:

(i) a modified version of the first composite signal from which the individual audio signals are removed, and (ii) a modified version of each of the individual audio signals.

7. The apparatus of claim 6, wherein the memory and computer program code are further configured such that the rendering audio is performed such that the modified version of an individual audio signal comprises a wet version of said individual audio signal, generated by applying an impulse response of the capture space to the individual audio signal.

8. The apparatus of claim 7, wherein the memory and computer program code are further configured such that the rendering audio is performed such that the wet version of the individual audio signal is further mixed with a dry version of the individual audio signal.

9. The apparatus of claim 3, wherein the memory and computer program code are further configured such that the rendering audio is performed such that for a user device position within the second area, audio rendering is performed whereby:

(i) the position of the audio sources change to reflect a rotational change in user device position; or (ii) the position of the audio sources change using volumetric audio rendering based on signals from the first spatial audio capture apparatus.

10. An apparatus, comprising:

at least one processor; and at least one memory including computer program code;

the at least one memory and the computer program code configured to, with the at least one processor, cause the apparatus at least to perform:

receiving, from a first spatial audio capture apparatus, a first composite audio signal comprising components derived from one or more sound sources in a capture space;

identifying a position of a user device in relation to the first spatial audio capture apparatus;

responsive to the position of the user device corresponding to a first area associated with the position of the first spatial audio capture apparatus, rendering audio representing the one or more sound sources to the user device, the rendering being performed differently dependent on whether or not individual audio signals from each of the one or more sound sources can be successfully separated from the first composite signal, wherein successful separation is determined by calculating, for each individual audio signal, a measure of success for the separation and by determining whether the measure of success meets a predetermined success threshold; and providing video data for rendering to a display screen of the user device, the video data representing captured video content and further comprising an indication of whether the user device position corresponds to the first area or another area.

11. The apparatus of claim 10, wherein the video data is provided such that the video data comprises an indication that a boundary of the first area with the other area is being approached and that a change in audio rendering will result from crossing the boundary.

12. A method, comprising:

receiving, from a first spatial audio capture apparatus a first composite audio signal comprising components derived from one or more sound sources in a capture space;

receiving individual audio signals derived from each of the one or more sound sources;

identifying a position of a user device in relation to the first spatial audio capture apparatus; and responsive to the position of the user device corresponding to a first area associated with the position of the first spatial audio capture apparatus, rendering audio representing the one or more sound sources to the user device, the rendering being performed differently dependent on whether or not the individual audio signals can be successfully separated from the first composite signal, wherein successful separation is determined by calculating, for each individual audio signal, a measure of success for the separation and by determining whether the measure of success meets a predetermined success threshold, wherein the rendering audio is performed such that the measure of success is calculated using one or more of:

a correlation between a remainder of the composite audio signal and at least one reference audio signal;

a correlation between a frequency spectrum associated with the remainder of the composite audio signal and a frequency spectrum associated with a reference audio signal; and a correlation between a remainder of composite audio signal and a component of a video signal corresponding to the composite audio signal.

13. A computer program embodied on a non-transitory computer-readable medium, said computer program comprising computer-readable instructions which, when executed by computing apparatus, cause the computing apparatus to:

receiving, from a first spatial audio capture apparatus a first composite audio signal comprising components derived from one or more sound sources in a capture space;

receiving individual audio signals derived from each of the one or more sound sources;

identifying a position of a user device in relation to the first spatial audio capture apparatus; and responsive to the position of the user device corresponding to a first area associated with the position of the first spatial audio capture apparatus, rendering audio representing the one or more sound sources to the user device, the rendering being performed differently dependent on whether or not the individual audio signals can be successfully separated from the first composite signal, wherein successful separation is determined by calculating, for each individual audio signal, a measure of success for the separation and by determining whether the measure of success meets a predetermined success threshold, wherein the rendering audio is performed such that the measure of success is calculated using one or more of:

a correlation between a remainder of the composite audio signal and at least one reference audio signal;

a correlation between a frequency spectrum associated with the remainder of the composite audio signal and a frequency spectrum associated with a reference audio signal; and a correlation between a remainder of composite audio signal and a component of a video signal corresponding to the composite audio signal.

* * * * *